United States Patent [19]

Abuyama et al.

[11] Patent Number: 4,579,443

[45] Date of Patent: Apr. 1, 1986

[54] IMAGE-FORMING APPARATUS

[75] Inventors: Yasuo Abuyama, Ebina; Fumito Ide, Zama, both of Japan

[73] Assignee: Kabushiki Kaisha Toshiba, Kawasaki, Japan

[21] Appl. No.: 711,659

[22] Filed: Mar. 14, 1985

[30] Foreign Application Priority Data

Apr. 27, 1984 [JP] Japan ..... 59-85642

[51] Int. Cl.[4] ..... G03G 15/00; G03G 15/01

[52] U.S. Cl. ..... 355/4; 355/14 R; 355/14 C

[58] Field of Search ..... 355/14 R, 14 C, 4, 3 R

[56] References Cited

U.S. PATENT DOCUMENTS

| | | | |
|---|---|---|---|
| 4,099,860 | 7/1978 | Connin | 355/14 R |
| 4,165,165 | 8/1979 | Iwami et al. | 355/4 |
| 4,189,224 | 2/1980 | Sakai | 355/4 |
| 4,204,728 | 5/1980 | Goshima et al. | 355/4 |

*Primary Examiner*—A. C. Prescott

*Attorney, Agent, or Firm*—Schwartz, Jeffery, Schwaab, Mack, Blumenthal & Evans

[57] ABSTRACT

A copying or printing machine comprises a microcomputer including a random access memory in which a set of coded signals may be written in and read out, a read-only memory having a sequence control for accomplishing printing or copying operation, and a processing unit operative to reproduce a copy of an original. The machine is provided with a first developing device devoted to colored development and an alternately-used second developing device devoted to black development. If the interrupt copying mode is set up during a copying run, copying conditions for the copying run are stored in the RAM, and the interrupt copying run is allowed. In that case, irrespective of copying conditions of the previous copying run, the interrupt copying mode permits the second developing device to be automatically selected. Upon the termination of the interrupt copying run, copying conditions for the previous copying run are read from the RAM, to permit the run to be completed. The above-mentioned control is effected by a sequence control program stored in the ROM.

15 Claims, 28 Drawing Figures

IMAGE-FORMING APPARATUS

BACKGROUND OF THE INVENTION

1. Field of the Invention

This invention relates to an image-forming apparatus, such as a copying machine or printer, for reproducing monochromatic or multicolored images.

2. Description of the Prior Art

Monochrome copying machines which permit color images other than black to be obtained have been put in practical use as a result of the evolution of color-image technology. Such colored images are obtained with a developing device containing color developers other than black prepared as a cartridge along with sensitized material and by selectively inserting into a copying machine the appropriate cartridge with the developing device containing a required color developer. These operations are very troublesome. To solve this problem, a color copying machine has been introduced which can reproduce variously colored pictures by selecting one of two or more developing devices prepared for different color development. This copying machine is provided with an interrupt copying function which, by setting an interrupt copying mode during one copy run, allows another copy run to be performed.

Hence, the copying machine which selects and makes use of one of multiple developing devices, during a copy run for reproducing one-color image (for example, red), is capable of introducing an image of a second color by setting the interrupt copying mode and performing another copy run.

However, the copy run in the interrupt copying mode must generally be conducted in a comparatively short time period, and reproduces only reference color (for example, black) images, in most cases. Selection of images in such cases also requires the operator to perform unnecessary operations.

SUMMARY OF THE INVENTION

Accordingly, it is an object of the present invention to provide an image-forming apparatus which permits selection of one of several image-forming modes for image-forming in multiple colors, including the reference color, and forms images in the selected image-forming mode.

Another object of the present invention is an image-forming apparatus which has the capability to automatically establish the reference color image-forming mode when the interrupt copying mode is set.

Still another object of the present invention is an image-forming apparatus which is convenient to use and which performs well.

These and other objects are achieved by an image-forming apparatus comprising:

selection means for selecting one of a first color and a preset reference color as a selected color;

interrupt means for selectively causing said image-forming apparatus to operate in an interrupt mode;

image-forming means responsive to said selector means for forming said image on a recording medium in said selected color when said image-forming apparatus operates in a mode other than said interrupt mode; and control means, responsive to said interrupt means and controllingly connected to said image-forming means, for causing said image-forming means to be unresponsive to said selection means and to form said image on said recording medium in said preset reference color regardless of whether said preselected reference color or said selected color has been selected when said image-forming apparatus operates in said interrupt mode.

Other and further objects, features, and advantages of the present invention will become understood more fully from the following description taken in connection with the accompanying drawings.

DETAILED DESCRIPTION OF PREFERRED EMBODIMENTS

Figure 1:
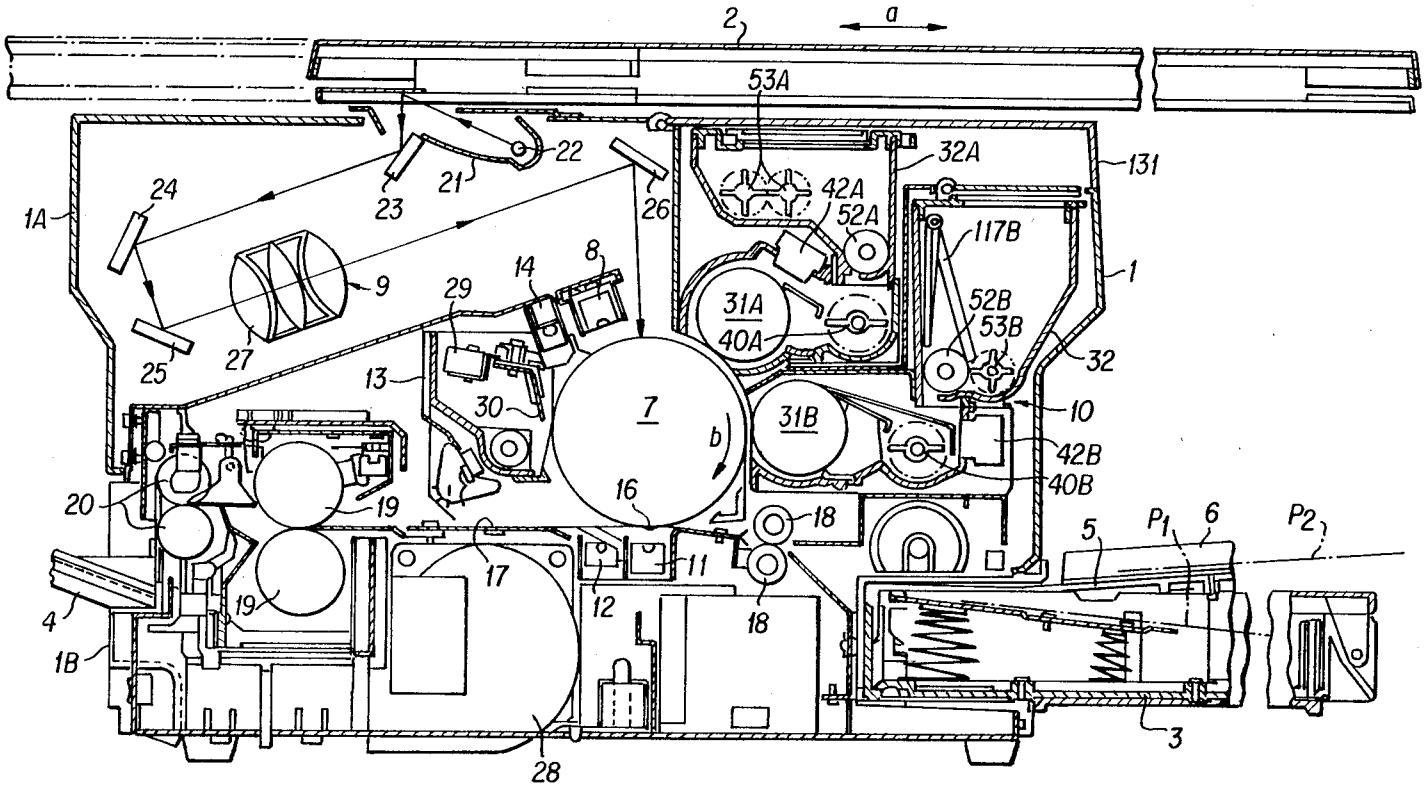
FIG. 1 is a front view of the inside of a copying machine to which the present invention is applied.

FIG. 1 shows a two-color copying machine, as an example of the image-forming apparatus implemented by this invention. The main body 1 of the copying machine is equipped with a document stage 2. The document stage 2 is capable of reciprocating in the horizontal direction (direction of the arrow a). The right side of the main body 1 is equipped with a paper supply cassette 3, and the left side with a paper discharge tray 4. A cassette cover 5 of the paper supply cassette 3 is used as a manual supply 6 to manually feed paper P2 as needed.

A drum 7, coated with light-sensitive material, is installed nearly in the center of the main body 1. Around the drum 7 are a charger 8, an optical system 9, a two-color developing device 10 to be described later, a transfer charger 11, a separation charger 12, a cleaning device 13, and an erase lamp 14.

At the lower section of the main body 1, a paper routing path 17 is formed which leads paper P1, taken automatically from the paper supply cassette 3 via a paper feeding roller 15 or paper P2 supplied manually from the manual supply 6, through an image-forming section 16 located between the drum 7 and the transfer charger 11 to the paper discharge tray 4.

At the upstream side of the image duplicating section 16 of the paper routing path, a register roller 18 is installed, and at the downstream side, a fuser roller 19 as the fixed device and a paper discharge roller 20 are installed.

The optical system 9 is made up of an exposure lamp 22, a reflector 21, mirrors 23 through 26, and a lens 27.

The drum 7 is driven by a drive mechanism (not shown) in the direction of the arrow b synchronously with the document stage 2. The document image electrified uniformly by the charger 8 and irradiated by the exposure lamp 22 is focused on the drum 7 by the optical system 9 to form a corresponding electrostatic latent image. The latent image thus formed is developed by the developing device 10, and the developed image is fed to the transfer charger 11.

On the other hand, the paper P1 or P2, supplied automatically or manually, is fed by the register roller 18, permitting the developed image formed on the drum 7 to be duplicated by the transfer charger 11. The paper P1 or P2 duplicating the developed image is released from the drum 7 by the separation charger 12.

The released paper is led through the paper routing path 17 to the fuser roller 19, where the duplicated image is fixed. Then, the paper having the fixed image thereon is discharged to the paper discharge tray 4 by the paper discharge roller 20. After the developed image is duplicated on the paper P1 (P2), the residual toner on the drum 7 is cleaned by the cleaning device 13, and the afterimage on the drum 7 is eliminated by the erase lamp 14, to prepare for the next copying operation.

In the main body 1, upper and lower frames (not shown) are supported by a supporting rod (not shown) at an end so that the other ends of both the frames are opened at a desired angle (for example, about 30 degrees). The upper frame is equipped with the charger 8, the optical system 9, the exposure lamp 22, the developing device 10, the cleaning device 13, and the erase lamp 14 around the drum 7 by appropriate means, as well as with the document stage 2 and the paper supply roller 15, making up the upper unit 1A.

The lower frame is equipped with a paper supply cassette 3, a transfer charger 11, a separation charger 12, a fuser roller 19, a paper discharge roller 20, and a paper discharge tray 49, as well as the main motor 28 by appropriate means, making up the lower unit 1B. Construction is such that, with the front cover of the main body 1 removed, the main body can be opened and closed along the paper routing path 17 of the paper P1 (P2) via a main body open/close device.

A blade solenoid 29 connects and disconnects a cleaning blade 30 of the cleaning device 13 to and from the drum 7.

Presented below is a detailed description of the developing device 10. As detailed in FIG. 2, the developing device 10 selectively drives a first developing roller 31A and a second developing roller 31B, permitting any one color other than black (for example, red, yellow, blue or green) to be developed. The developing device 10 is divided into a first developing device 32A including the first developing roller 31A and a second developing device 32B including the second developing roller 31B, both of which can be mounted to or removed from the main body 1.

The upper, first developing device 32A is removable along the vertical direction in FIG. 1. The lower, second developing device 32B is removable from the main body 1 for maintenance and inspection. The commonly-used black developer is normally used in the lower, second developing device 32B, while color developers would then be used in the upper, first developing device 32A.

The first developing device 32A is composed of a developing mechanism 33A and a developer supply 34A. The developing mechanism 33A also includes a doctor blade 37A which is installed at the sliding part of a developer magnetic brush 35A formed on the surface of the developing roller 31A with the drum 7, i.e., upstream of the developing position 36A. The doctor blade 37A regulates the thickness of the developer magnetic brush 35A.

A scraper 39A is installed downstream of the developing position 36A and scrapes the developer magnetic brush 35A on the surface of the developing roller 31A into a developer storage 38A. A developer agitator 40A, contained in the developer storage 38A, is accommodated in a casing 41A. The position corresponding to the upper portion of the developing roller 31A in the casing 41A is provided with a developer concentration detector 42A which detects the developer concentration by magnetically sensing variations of the permeability of the developer G1.

The developing roller 31A is composed of a magnetic roller 43A, the center of which is positioned on a line L2 passing through the rotating center of the drum 7 and making an angle $\alpha$ (about 51 degrees) with the horizontal line L1, and of a sleeve 44A which is mated externally with the magnetic roll 43A and turns clockwise. The magnetic roll 43A is provided with five magnetic poles 45A thru 49A; magnetic poles 45A, 47A and 49A are north poles, and the poles 46A and 48A are south poles. The angle $\theta_1$ between poles 45A and 46A is set at about 50 degrees, the angle $\theta_2$ between poles 46A and 47A at about 71 degrees, the angle $\theta_3$ between poles 47A and 48A at about 60 degrees, and the angle $\theta_4$ between poles 48A and 49A at about 60 degrees.

The developer supply 34A is composed of a hopper 51A having a developer supply port 50A which faces the developer storage 38A of the developing mechanism 33A. A developer supply roller 52A is set in the hopper 51A so that the developer supply port is blocked, and a pair of agitating rollers 53A, 53A agitate the developer G1 in the hopper 51A so that the developer G1 is carried to the developer supply roller 52A.

The second developing device 32B is almost the same as the first developing device in basic construction; the former is different from the latter in the shape of the hopper 51B of a developer supply 34B, the arrangement of the magnetic poles of a magnetic roll 43B for the developing roller 31B and the position of a developer concentration detector 42B. A further difference is in the point that a scraper 54 with a gradient of about 20 degrees is added at the accompanying neck (about 50 mm).

The magnetic roll 43B of the developing roller 31B is provided with four magnetic poles 45B through 48B; poles 45B and 47B are north poles, while poles 46B and 48B are south poles. The angle $\theta_5$ between magnetic poles 45B and 46B is set at about 78 degrees, the angle $\theta_6$ between poles 46B and 47B at about 70 degrees, and the angle $\theta_7$ between poles 47B and 48B at about 80 degrees. The magnetic roll 43B is installed so that its center is positioned on a line L3 drawn through the rotating center of the drum 7 and the angle $\beta$ (about 1 degree) against the horizontal line L1.

The construction of the magnetic rolls 43A and 43B for the first and second developing devices 32A and 32B is such that they can be rotated and displaced with their rotating angle near 25 degrees, permitting the developer magnetic brushes 35A and 35B to be formed on or removed from the surfaces of the developing rollers 31A and 31B. (Developer magnetic brush 36B is visible in FIG. 3.) The developer magnetic brush 35A or 35B is formed only on the surface of the developing roller 31A or 31B for either the first developing device 32A or the second developing device 32B by switching the magnetic rolls 43A and 43B of the first and second developing devices 32A and 32B to certain predetermined positions by magnetic roll drive means described later.

Figure 2:
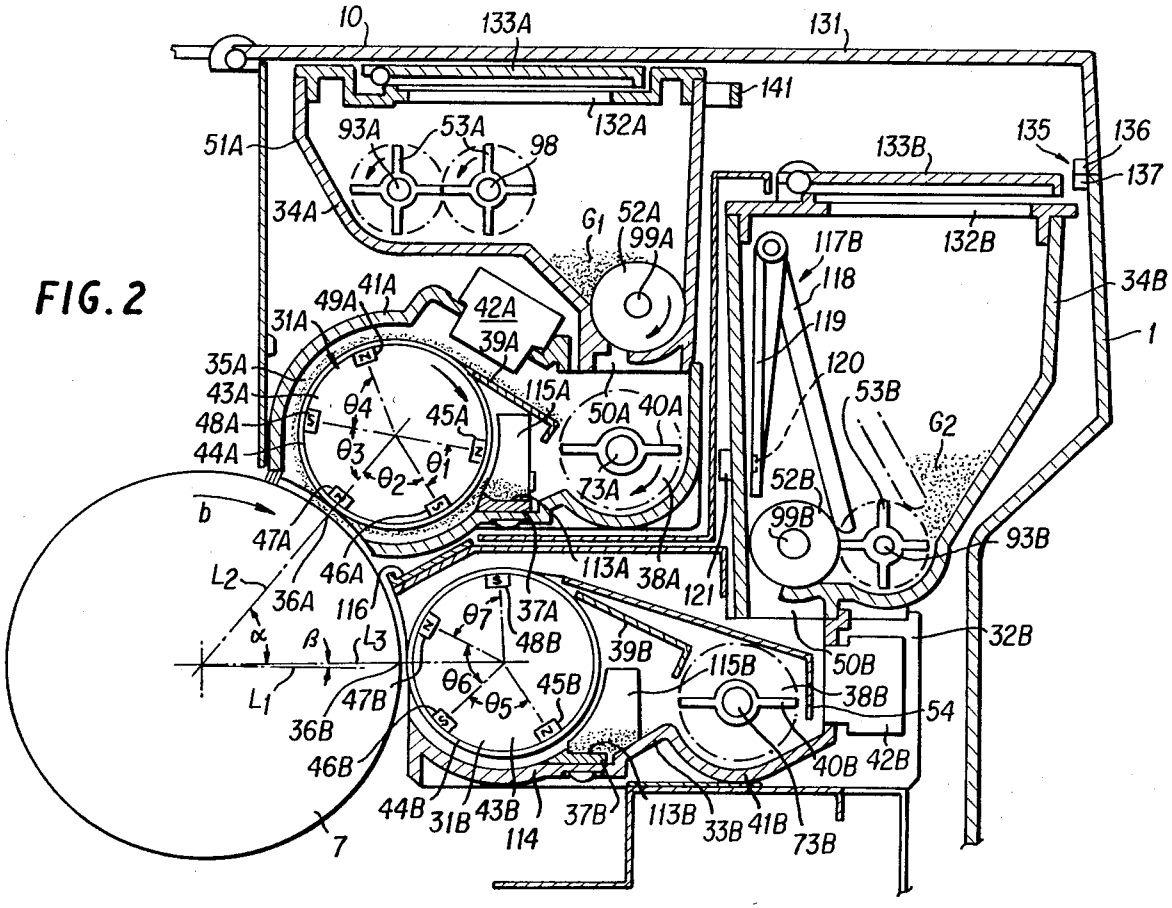
FIGS. 2 and 3 are front views of the inside of a developing device pertaining to the copying machine shown in FIG. 1.

When the first developing device 32A is operated, the magnetic roll 43A of the first developing device 23A, as shown in FIG. 2, is changed so that the magnetic pole 47A faces the developing position 36A and the doctor blade 37A is positioned nearly midway between magnetic poles 45A and 46A. The magnetic roll 43B of the second developing device 32B is changed so that the magnetic pole 45B faces a doctor blade 37B. The developer magnetic brush 35A is generated only on the surface of the developing roller 31A for the first developing device 32A.

Figure 3:
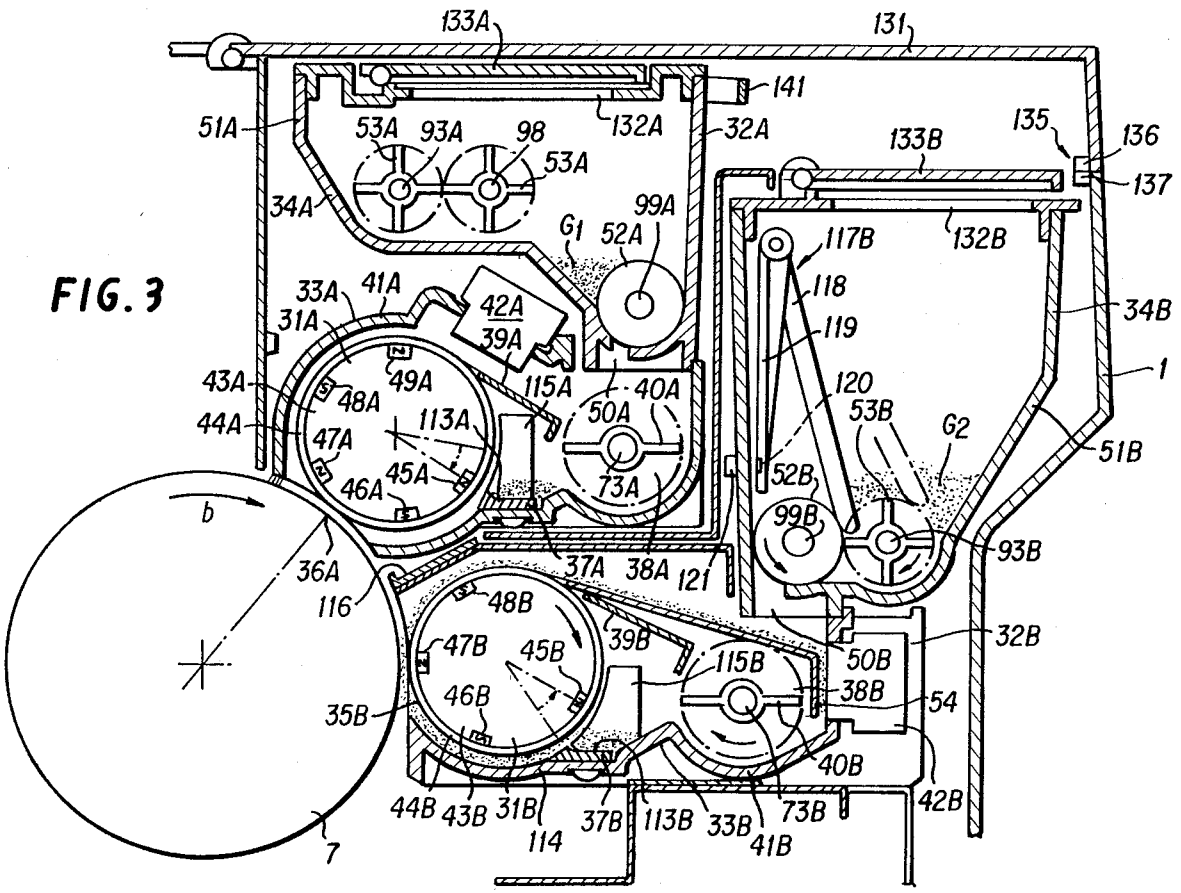

When the second developing device 32B is operated, the magnetic roll 43A for the first developing device 32A is turned and displaced by about 25 degrees clockwise from the position in FIG. 2 so that the magnetic pole 45A faces the doctor blade 37A, and the magnetic roll 43B for the second developing device 32B is turned and displaced by about 25 degrees counterclockwise from the position in FIG. 2 so that the doctor blade 37B is located nearly halfway between the magnetic poles 45B and 46B, as shown in FIG. 3. The developer magnetic brush 35B is formed only on the surface of the developing roller 31B for the second developing device 32B.

If the magnetic poles 45A and 45B of the magnetic rolls 43A and 43B face the doctor blades 37A and 37B, the latter being made of non-magnetic material, the developer magnetic brushes 35A and 35B are not formed on the surfaces of the developing rollers 31A and 31B, because the magnetic poles 45A and 45B attract developers G1 and G2 with a weak force due to sparse magnetic brushes, making regulation by the doctor blades 37A and 37B easily possible. Thus, even though the sleeve 44A and 44B are rotated, the developers G1 and G2 do not pass the doctor blades 37A and 37B.

Figure 4:
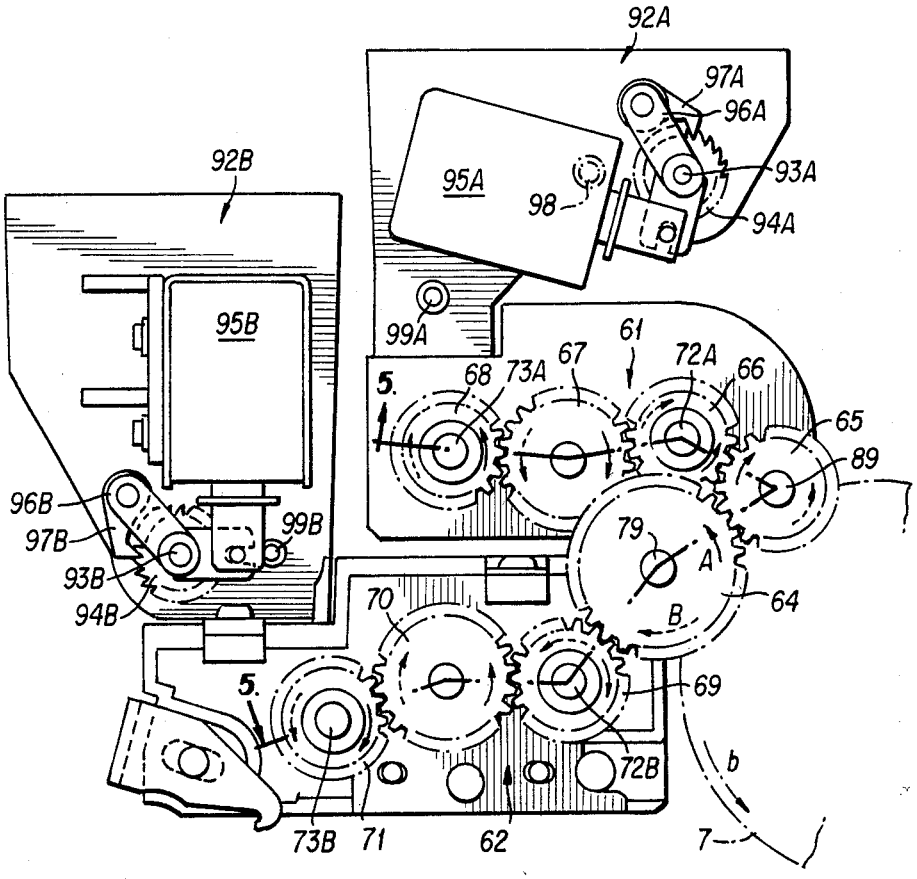
FIG. 4 is a front view of the drive mechanism of the developing device shown in FIGS. 2 and 3.
Figure 5:
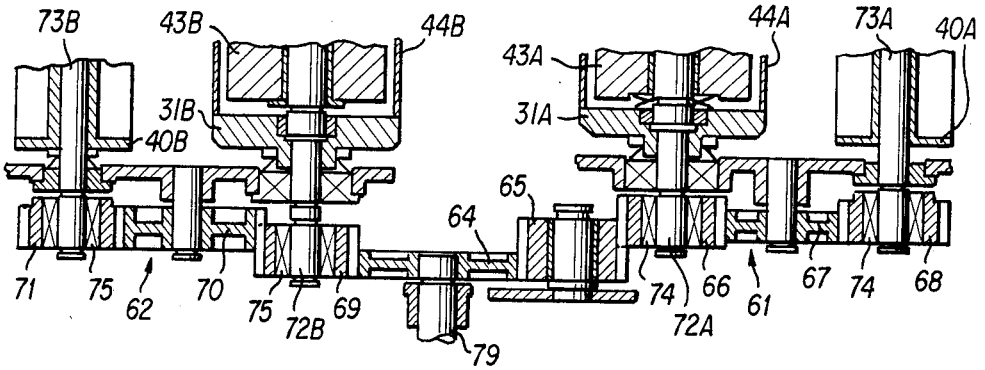
FIG. 5 is a sectional view of an evolution of the gear mating state of the drive mechanism shown in FIG. 4.
Figure 6:
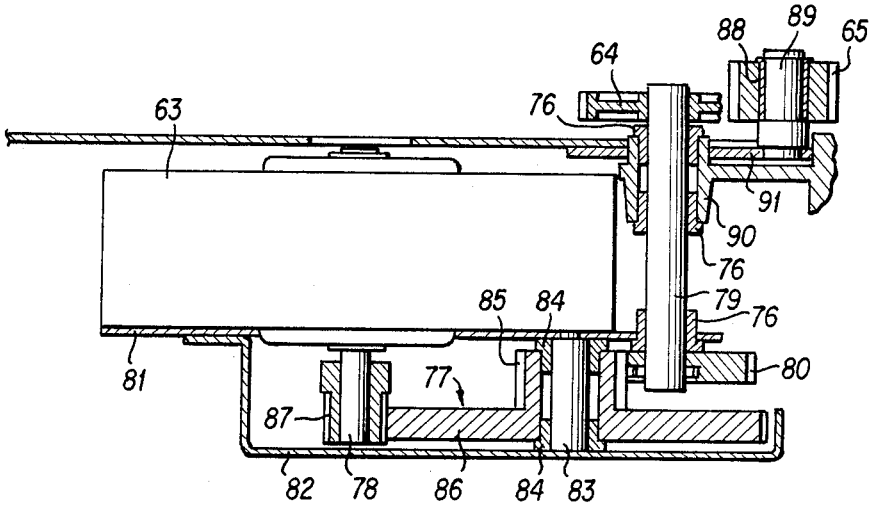
FIG. 6 is a sectional view of part of the drive mechanism shown in FIG. 4.

The first developing device 32A, which includes the sleeve 44A of the developing roller 31A, the developer agitator 40A, and the developer supply roller 52A, receives a driving force transmitted via a first driving force transmission system 61 to be described later. The second developing device 32B, including the sleeve 44B of the developing roller 31B and the developer agitator 40B, receives a driving force transmitted via a second driving force transmission system 62 to be described later. As shown in FIGS. 4 and 6, the structures of the first and second driving force transmission systems 61 and 62 permit a reversible motor 63 to be used as a common driving source and to revolve positively or negatively (clockwise or counterclockwise), leading to the selective operation of the driving system for either the first developing device 32A or the second developing device 32B.

The following is a detailed description of the driving force transmission system with reference to FIGS. 4 and 6. The first driving force transmission system 61 consists of an intermediate gear 65 engaged with a driving gear 64, a first follower 66 engaged with the intermediate gear 65, an intermediate gear 67 engaged with the follower 66, and a second follower 68 engaged with the intermediate gear 67. The second driving force transmission system 62 consists of a third follower 69 engaged with the driving gear 64, an intermediate gear 70 engaged with the follower 69, and a fourth follower 71 engaged with the intermediate gear 70.

If the driving gear 64 revolves forwardly (i.e., in the direction of the arrow A of FIG. 4), the gears 65 thru 68 in the first driving force transmission system and the gears 67 thru 71 in the second driving force transmission system revolve in the direction of the solid arrow. If the driving gear 64 revolves reversely (i.e., in the direction of the dashed arrow B in FIG. 4), the gears 65 thru 68 in the first driving force transmission system 61 and the gears 69 thru 71 in the second driving force transmission system 62 are revolved in the direction of the dashed arrow.

The first follower 66 and the second follower 68 are respectively fitted to the driving shaft 72A equipped with the sleeve 44A for the first developing roller 31A and the driving shaft 73A for the developer agitator 40A via one-directional clutches 74. Only when gears 66 and 68 are revolved in the solid arrow direction, or when the driving gear 64 is revolved positively, is a driving force applied to the driving shafts 72A and 73A so that they are revolved in the direction of the one-dot chain line. The third follower 69 and the fourth follower 71 are respectively fitted to the driving shaft 72B equipped with the sleeve 44B for the second developing roller 31B and to the driving shaft 73B for the developer agitator 40B via one-directional clutches 75. Only when the gears 69 and 71 are revolved in the direction of the dashed arrow, or when the driving gear is revolved reversely, are the driving shafts 72B and 73B driven and revolved in the direction of the one-dot chain line.

The driving gear 64, as shown in FIG. 6, is supported by bearings 76 so that it can revolve freely, and is interlockingly fitted to the revolving shaft 79 and the driving shaft 78 for the reversible motor 63 via the gear mechanism 77. The gear 80 is fitted to the revolving shaft 79, which is engaged with the gear 85 fitted to the sub-shaft 83 installed between a motor attachment frame 81 and an accompanying stud 82 via bearings 84. A gear 85 is accompanied by a greater-diameter gear 86, which is engaged with a gear 87 fitted on the driving shaft 78 for the reversible motor 63. Thus, the positive or reverse revolution of the driving shaft 78 by the reversible motor 63 is transmitted to the revolving shaft 79 via gears 87, 86, 85 and 80, permitting the first and second developing devices 32A and 32B to be operated selectively merely by choosing the positive or reverse revolution of the reversible motor 63.

The positive or reverse revolution of the reversible motor 63 is selected by pressing the appropriate color selection key on the operator panel as described later.

The intermediate gear 65 engaged with the driving gear 64 and first follower 66 is fitted via a bearing 88 so that it may revolve freely with respect to a supporting shaft 89. The supporting shaft 89 is fitted to a rocking arm 91 over a housing 90 supporting bearings 76 for the revolving shaft 79 as the revolving center, and can change its position so that it may be engaged securely with the driving gear 64 and the first follower 66.

One agitating roller 53A for the first developing device 32A is driven intermittently via a first actuating mechanism 92A shown in FIG. 4, while the other agitating roller 53A and the developer supply roller 52A interlock with the agitating roller 53A to be driven simultaneously therewith. One end of a shaft 93A for the agitating roller 53A in the first developing device 32A is provided with a ratchet 94A, which is driven intermittently a certain amount via a ratchet pawl 97A fitted on the rocking arm 96A in combination with the on/off operation of a solenoid 95A. The shafts 93A and 98 for the agitating rollers 53A and 53B, and the shaft 99A for the developer supply roller 52A are mated with sprockets not shown and with an endless chain (not shown). This driving force transmission system (not shown) permits the agitating rollers 53A and the developer supply roller 52A to be driven along with one another.

The agitating roller 53B and the developer supply roller 52B for the second developing device are simultaneously driven intermittently via the second actuating mechanism 92B having the same structure as the first actuating mechanism 92A and by a driving force transmission system having almost the same structure.

Figure 7:
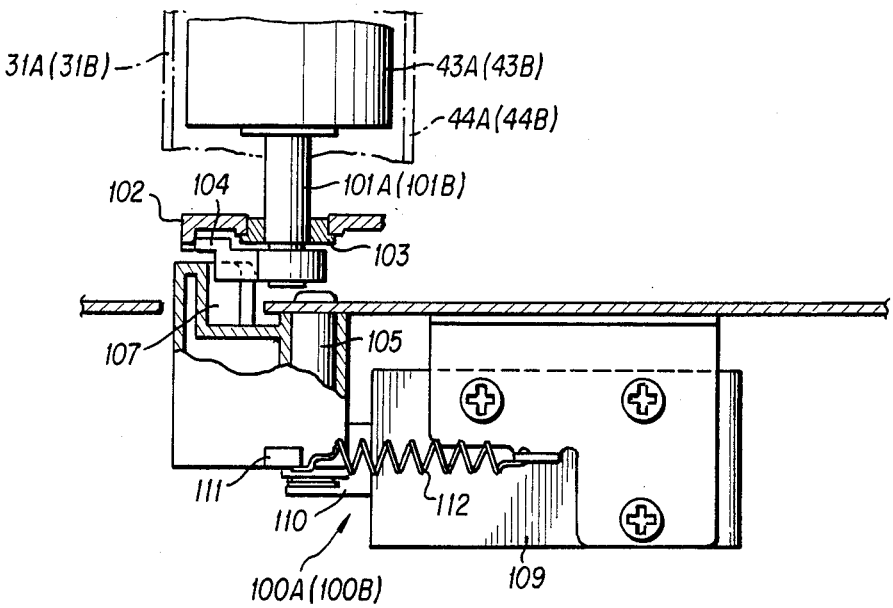
FIG. 7 is a front view covering a sectional view which shows the drive mechanism of the magnetic roll pertaining to the developing device shown in FIGS. 2 and 3.
Figure 8:
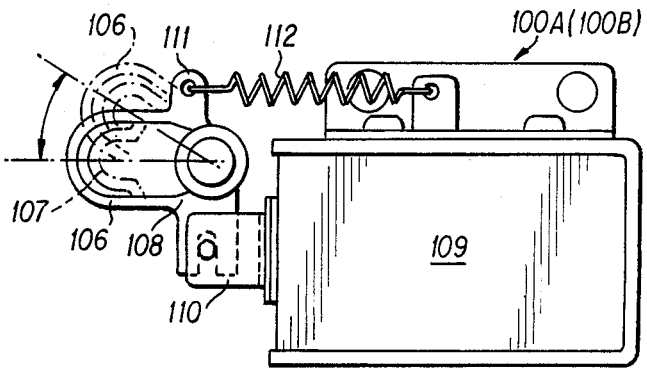
FIG. 8 is a side view of the drive mechanism shown in FIG. 7.
Figure 9A:
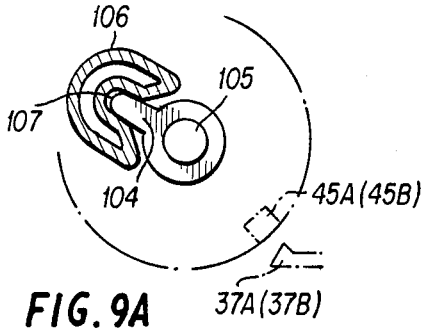
FIGS. 9*a* and 9*b* are side views devoted to explain turning variations of the magnetic roll of the developing device shown in FIGS. 2 and 3.
Figure 9B:
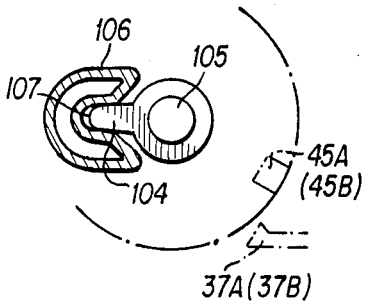

FIGS. 7, 8, 9(*a*) and 9(*b*) show a magnetic roll drive means 100A (100B) which displaces the magnetic roll 43A (43B) in order to form the developer magnetic brush 35A (35B) on or remove it from the surface of the developing roller 31A (31B). A shaft 101A (101B) for the magnetic roll 43A (43B) is supported at one end by a bearing 103 fitted in a frame 102, and its tip is equipped with a lever 104. The top of the lever 104 is mated at a mating groove 107 of a turning arm 106 fitted via a sub-shaft 105. A support 108 made below the supporting end of an arm 106 is connected to a plunger 110 of a solenoid 109, while one end of a pulling spring 112 is connected to a support 111 made at the top of support end.

When the solenoid 109 is turned off, the arm 106 holds the lever 104 at the position shown by the two-dot chain line in FIG. 8, or at the position which causes the magnetic pole 45A (45B) to face the doctor blade 37A (37B), as shown in FIG. 9(*a*), by the force of the pulling spring 112. Hence, with the solenoid 109 off, the developer magnetic brush 35A (35B) is not formed on the surface of the developing roller 31A (31B). With the solenoid 109 on, the arm 106 turns the lever 104 to the position shown by the solid line in FIG. 8, or to the position which causes the magnetic pole 45A (45B) to face the doctor blade 37A (37B), as shown in FIG. 9(*b*), against the force of the pulling spring 112. With the solenoid 109 on, the developer magnetic brush 35A (35B) is formed on the surface of the developing roller 31A (31B).

As shown in FIGS. 2 and 3, the doctor blade (37B) is composed of a main body (113B) made of non-magnetic material, magnetic material 114 made of strip iron plates provided along the longitudinal direction of the doctor main body 113B, and magnetic materials 115B made of iron plates provided at both ends of the doctor main body 113B. The composition of the magnetic materials 114B and 115B is such that, when the magnetic pole 45B removes the developer G2 on the surface of the developing roller 31B against the doctor blade 37B, magnetic force lines are generated between the magnetic materials and the magnetic pole 45B to prevent the more securely attracted developer G2 from being removed.

The doctor blade 37A is composed of the doctor main body 113A made of non-magnetic material, and magnetic materials 115A made of iron plates provided at both ends of the doctor main body 113A. Doctor blade 37A operates similarly to doctor blade 37B to prevent developer G1 from being taken out. Unlike the doctor blade 37B, however, the doctor blade 37A is provided with non-magnetic material along the longitudinal direction of the doctor main body 113A. This prevents the developer G1 from being taken out, by means of magnetic force lines generated between the magnetic pole 45A of the developing roller 31A facing the doctor blade 37A and the magnetic pole 48B of the developing roller 31B.

As shown in FIGS. 2 and 3, a magnetic plate 116 is provided between the developing rollers 31A and 31B. This weakens the effect of the magnetic flux density and pole distribution on the magnetic roll 43A (43B), permitting the developer to be carried in a satisfactory manner.

A developer level detector 117B shown in FIGS. 2 and 3 produces an alarm when the amount of the developer G2 in the hopper 51B for the second developing device falls below a predetermined level, and is initiated when a permanent magnet 120 fitted on an actuator 119 accompanied by a detecting lever 118, which is displaced in accordance with developer amount, nears a reed switch 121. A developer level detector 117A (not shown) similar to the developer level detector 117B is also provided for the hopper 51A for the first developing device 32A.

Figure 10:
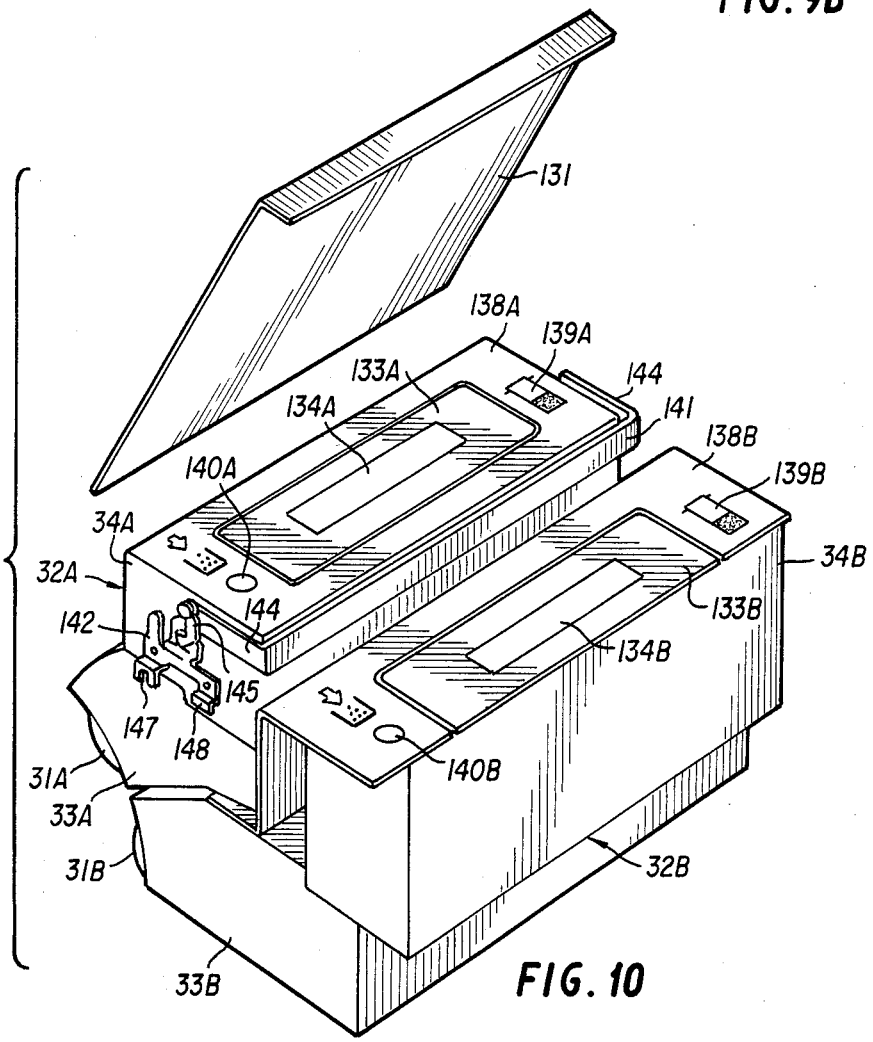
FIG. 10 is a partially exploded perspective view of the developer storage of the developing device shown in FIGS. 2 and 3 with the cover opened.

As shown in FIGS. 2, 3 and 10, the upper surface of the developing device 10 is provided with a hopper cover 131 which can be freely opened and closed and which makes up part of the upper surface of the main body 1. With the hopper cover 131 opened, a cap 133A, which opens and closes an upper opening 132A of the first developing device 32A for developer supply, and a cap 133B, which opens and closes an upper opening 132B of the second developing device 32B for developer supply, are accessible.

Developers G1 and G2 can be supplied easily from the upper surface by opening the caps 133A and 133B. The caps 133A and 133B are equipped with color indicators 134A and 134B, which permit each identification of the colors of the developers G1 and G2 stored inside and prevent an improper color developer from being poured into the developer supplies.

A cover open/close detector 135 shown in FIGS. 2 and 3 detects opening and closing of the hopper cover 131, and is composed of a permanent magnet 136 fitted on the top of the hopper cover 131 and a reed switch 137 as the detector which is turned on by the magnet's approach when the hopper cover 131, provided on the main body 1, is closed.

Figure 11A:
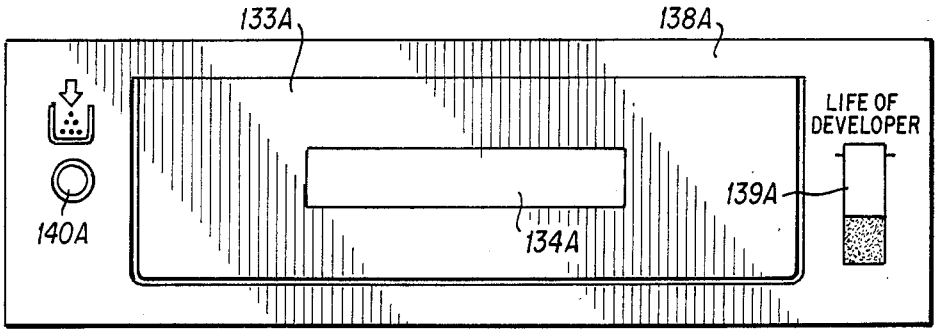
FIGS. 11*a* and 11*b* are plan views of the developer storage shown in FIG. 10.
Figure 11B:
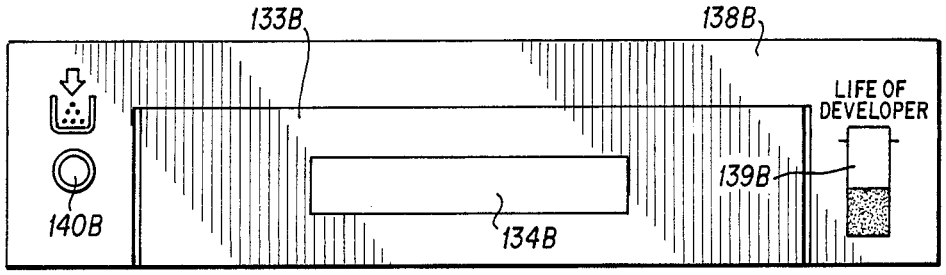

As shown in FIGS. 10, 11(*a*) and 11(*b*), both sides of the caps 133A and 133B on the upper surfaces and 138A and 138B of the hoppers 51A and 51B for the first and second developing devices 32A and 32B are equipped with accumulating timers 139A and 139B as life indicators 140A and 140B which produce an alarm when the developers in the hoppers 51A and 51B fall below a predetermined level. The accumulating timers 139A and 139B typically indicate the life of developers by measuring cumulative times that the sleeves 44A and 44B making up the developing rollers 31A and 31B are turned, and are generally implemented by an electrolyte accumulating timer such as that manufactured by Fuji Ceramics, Inc., and marketed under the designation "FC Timer."

Figure 12:
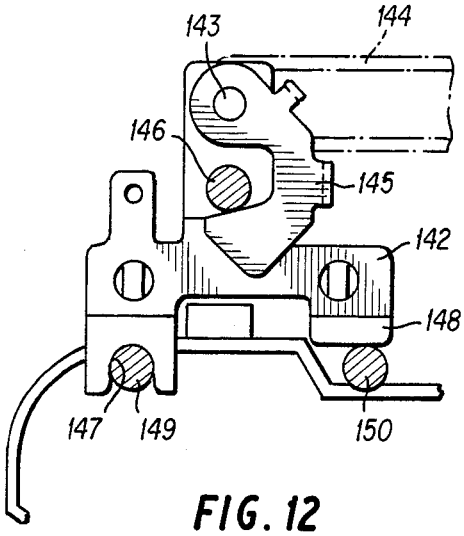
FIGS. 12, 13*a*, 13*b* and 13*c* are front views of the supporting structure of the developing device shown in FIGS. 2 and 3.
Figure 13A:
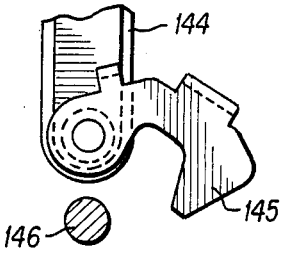
Figure 13B:
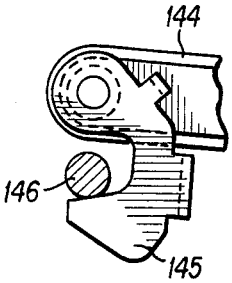
Figure 13C:
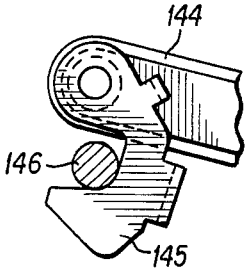

The first developing device 32A, which stores the color developer G1, is of a cartridge type and can be removed from the main body with ease by pulling upwardly on a handle 141. (See FIG. 10). The front and rear walls of the developer supply 34A for the first developing device 32A are equipped with positioning devices 142, which are provided on the supports 144 for both ends of the handle 141 via sub-shafts 143 so that they may be turned freely. The supports 144 of the handle 141, as shown in FIG. 12 and FIGS. 13(*a*), (*b*) and (*c*), are accompanied by a hook 145 which can rotate around the sub-shaft 143. The hook 145, in conjunction with a mating pin 146, restricts upward movement.

A mating groove 147, as the first positioning part made under the positioning device 142, and an edge surface 148, as the second positioning part, mate and contact and the positioning pins 149 and 159 provided on the main body 1 to hold the first developing device 32A in a predetermined position. When the handle 141 is lifted, the hook 145 is disengaged from the mating pin 146, as shown in FIG. 13(*a*); with the handle placed in the horizontal position, the hook 145 is engaged securely with the mating pin 146 so that the first developing device 32A is pushed downwardly, as shown in FIG. 13(*c*). Hence, the developing device 32A may be removed by lifting the handle 141, and the first developing device 32A may be fixed with ease by placing the handle 141 in the horizontal position.

If operation of the first developing device 32A has been selected by the color selection key, the magnetic rolls 43A and 43B are put in the state shown in FIG. 2, and the reversible motor is revolved forwardly. This permits the sleeve 44A of the first developing roller 31A to be turned clockwise in FIG. 2 and the developer magnetic brush 35A to be formed on the surface of the sleeve 44A.

A static latent image having been formed on the drum 7 is developed by the color developer G1. After the termination of the development of the static latent image, the magnetic roll 43A is turned by about 25 degrees, causing the magnetic pole 45A to face the doctor blade 37A. Thus, the developer magnetic brush 35A is no longer formed on the sleeve 44A, and the sleeve 44A is turned by a certain amount to remove the developer magnetic brush 35A. The developer magnetic brush 35B is not formed on the second developing roller 31B. Hence, the subsequent selection of either of the developing devices 32A and 32B does not result in improper color mixing.

If the second developing device 32B has been selected for black development, the magnetic rolls 43A and 43B are put in the state shown in FIG. 3, and the reversible motor 63 is revolved reversely. This permits the sleeve 44B of the second developing roller 31B to be turned clockwise in FIG. 3 and the developer magnetic brush 35B to be formed on the surface of the sleeve 44B. A static latent image on the drum 7 will be developed in black, and the developing operation will be terminated with the developer magnetic brush 35B being removed from the surface of the sleeve 44B.

The developer agitator 40A (40B) and the agitating roller 53A (53B) for the developing device 32A (32B) operate continuously during developing operations, and the developer supply roller 52A (52B) supplies the developer G1 (G2) in accordance with control signals based on signals outputed from the developer concentration detector 42A (42B). In this manner, good developing operations are maintained.

Figure 14:
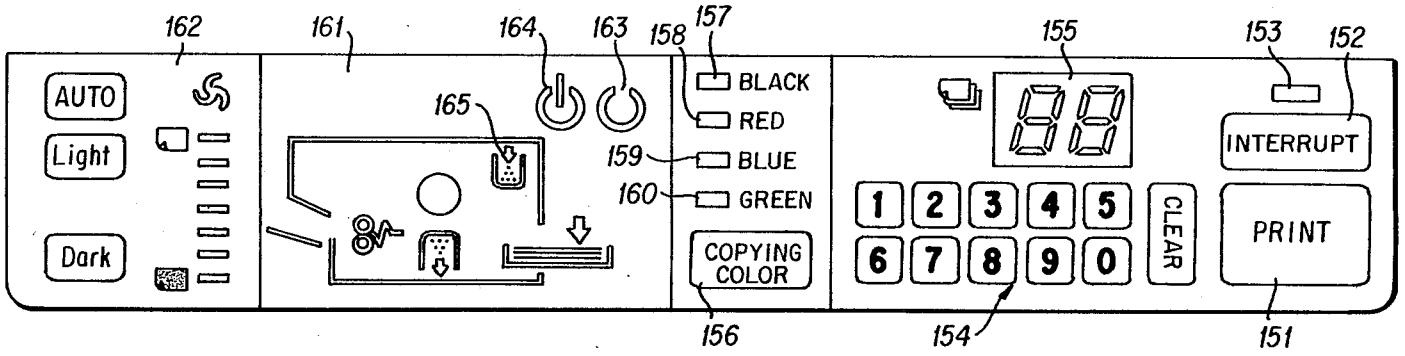
FIG. 14 is a front view of the operating panel for the copying machine.

FIG. 14 shows an operation panel, including a copying key 151 used to initiate copying operation, an interruption key 152 used to specify the interruption move for interruption copying, an interruption indicator 153 which indicates that the interruption mode has been selected, numeric keys 154 used to select the number of copies to be made, a copy count indicator 155, a color selection key 156 used to select a copying color (for example, black, red, blue, green), color indicators 157 thru 160 which display the color selected, a liquid crystal display 161 which gives information on the operating state, and a density setting device 162 used to set copying density.

The liquid crystal display consists of a symbol 162 which indicates that copying can be done, a symbol 164 which indicates that copying cannot be done, and a symbol 165 which indicates that the developer in the hopper for the developing device has been exhausted.

Color selection by the color selection key 156 is such that the appropriate colors can be selected alternately. If the first developing device 32A is for copying with red and the second developing device with black, the black copying mode is established automatically when the power is turned on, causing the second developing device 32B to be selected and the color indicator 157 to light. In this state, if the color selection key 156 is pressed, the red copying mode will be established, causing the first developing device 32A to be selected and the color indicator 158 to be lit. If the color selection key is pressed again, the black copying mode will be established again. In such a manner, the color selection key 156 permits the black copying mode and the red copying mode to be selected alternately.

Figure 15:
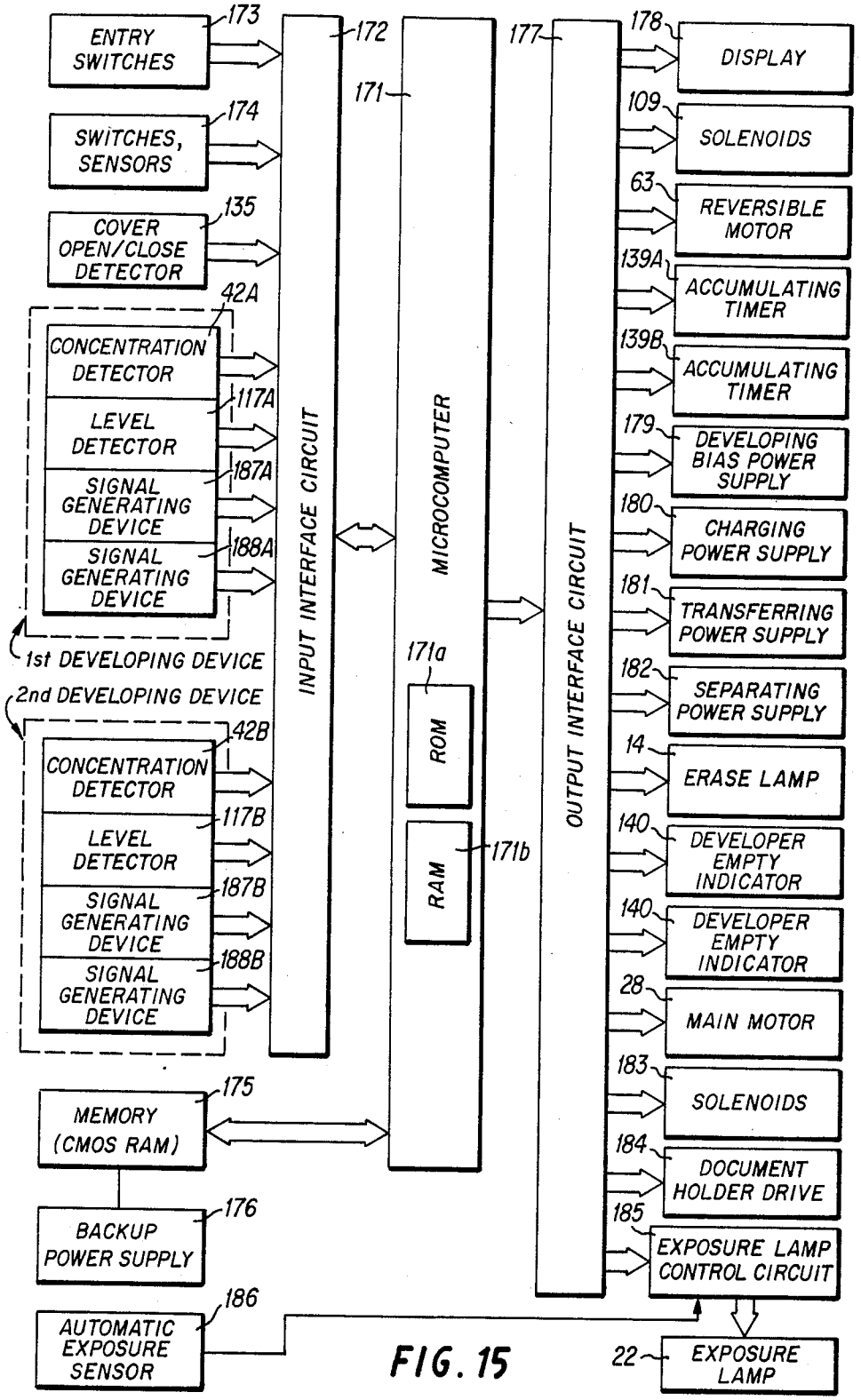
FIG. 15 is a schematic block diagram of the electric control system for the copying machine.

FIG. 15 shows the control circuit for the copier. A microcomputer 171, which controls the whole copying machine as the main control section, contains a ROM 171*a* for storing a control sequence program, a ROM 171*b* for storing copying condition data, and a processing unit. An input interface circuit 172 connects the input of the microcomputer 171 to the input or entry key switches 173 such as operation panel keys, other switches dedicated to copying operation, sensors 174, developer concentration detector 42A, the developer level detector 117A for the first developing device 32A, developer concentration detector 42B and developer level detector 117B for the second developing device 32B, and cover open/close detector 135. A memory 175 is connected to the microcomputer and to a back-up power supply 176 such as battery.

An output interface circuit 177 connects the output of the microcomputer 171 to indicators and displays 178 on the operation panel, the pole position selection solenoids 109 for the first and second developing devices 32A and 32B, the reversible motor 63, the accumulating timer 139A for the first developing device 32B, a developing bias power supply 179, a charging power supply 180 for the charger 8, a transferring power supply 180 for the charger 8, a transferring power supply 181 for the transfer charger 11, a releasing or separating power supply 182 for the separation charger 12, erase lamp 14, developer exhaustion indicators 140A and 140B, main motor 28, other solenoids 183, a document stage or holder driver 184 which drives the document stage 2, and an exposure lamp control circuit 185. The exposure lamp control circuit 185 controls the exposure lamp 22 in accordance with output signals of the photosensor for controlling the copy density detector 186 which detects light from the document on the document stage 2, and with signals from the microcomputer 171.

The first and second developing devices 32A and 32B are provided with a developing device presence/absence signal generating means 187A and 187B which indicates the presence or absence of the developing devices and an identification information generating means 188A and 188B which generates identification codes particular to the developing devices (which also indicate the colors of developers contained). These signals and identification codes are also entered via the interface circuit to the microcomputer 171.

Figure 16:
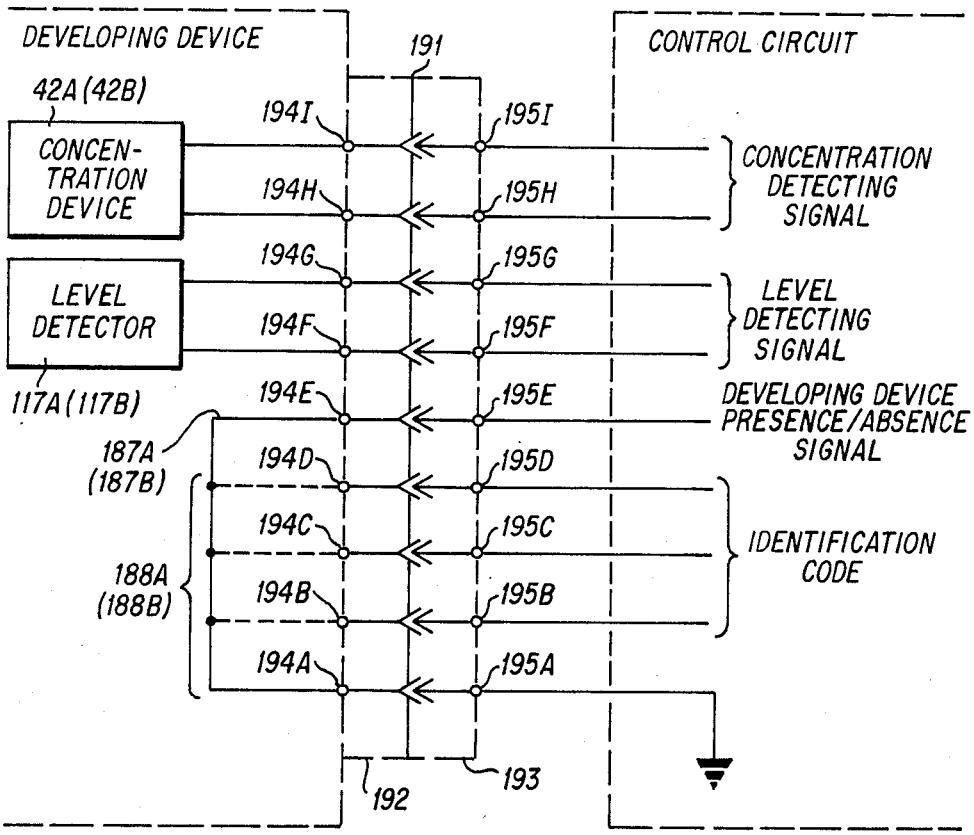
FIG. 16 is a block diagram which explains the control signal flow with the developing device set in the copying machine.
Figure 17A:
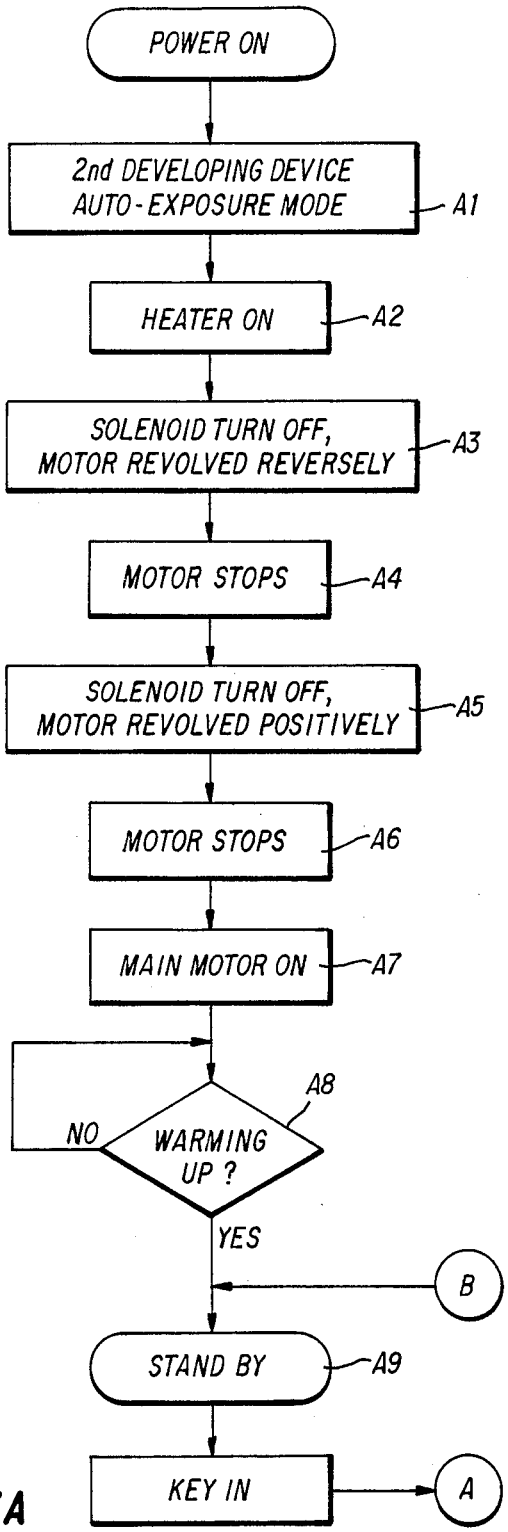
FIGS. 17*a*, 17*b*, 17*c*, 17*d*, 18*a*, 18*b*, 19*a* and 19*b* are flowcharts which explain operation during power on, copying operation, and the interrupt copying operation of the copying machine, respectively.
Figure 17B:
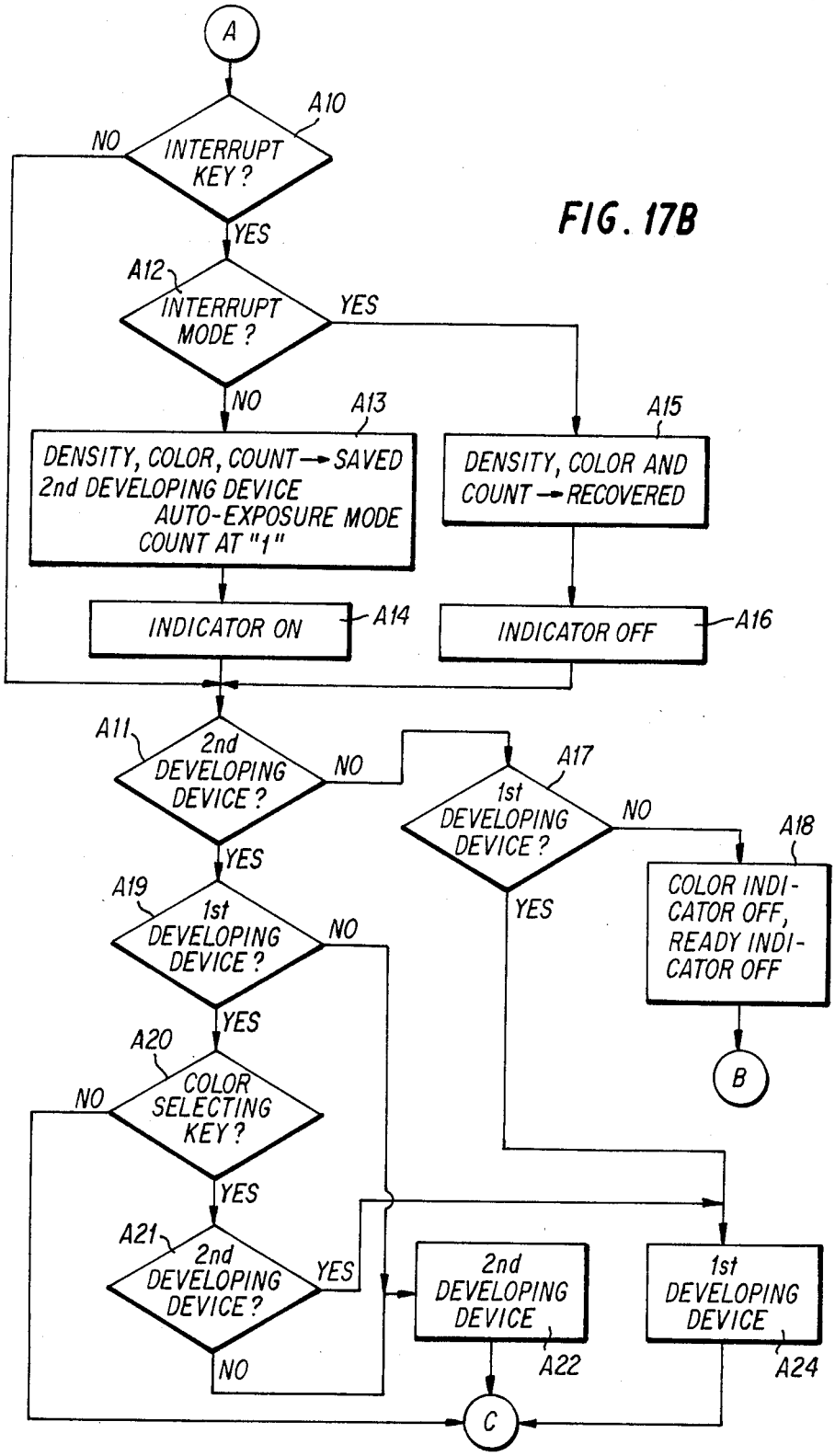
Figure 17C:
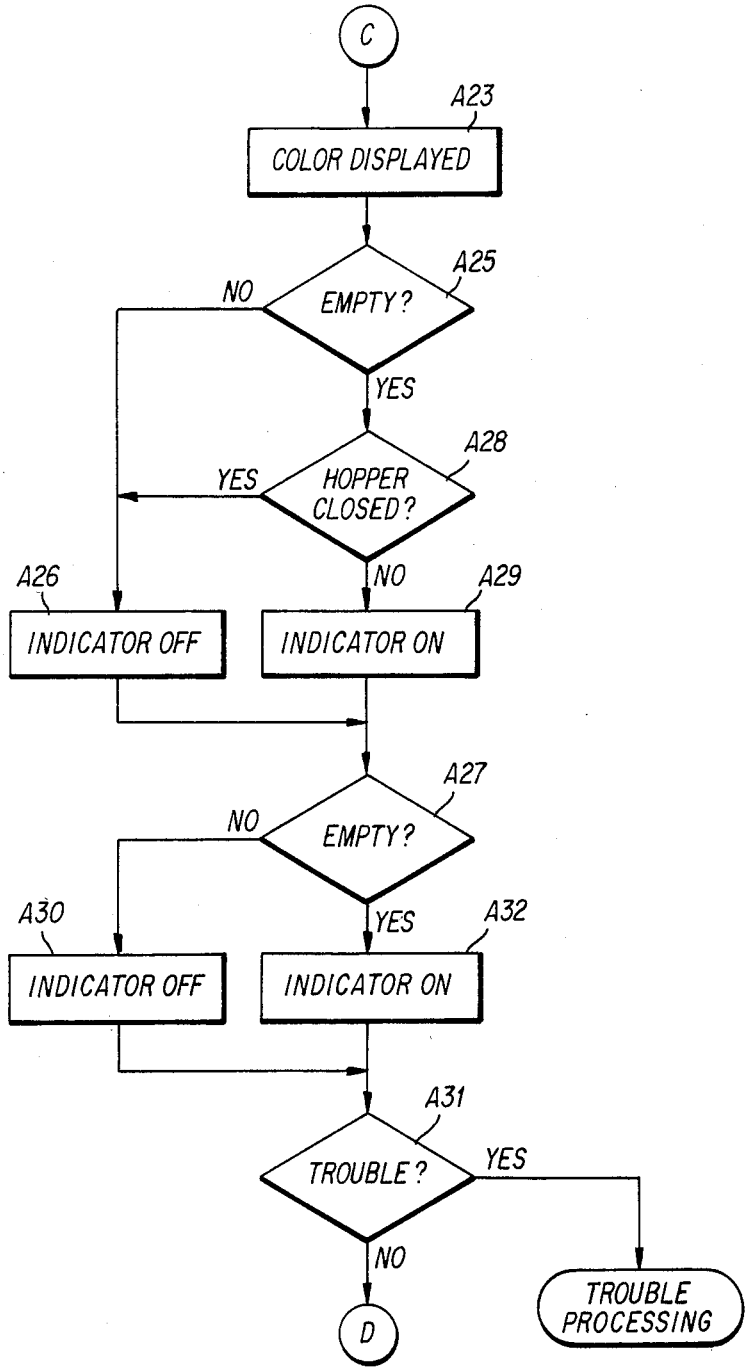
Figure 17D:
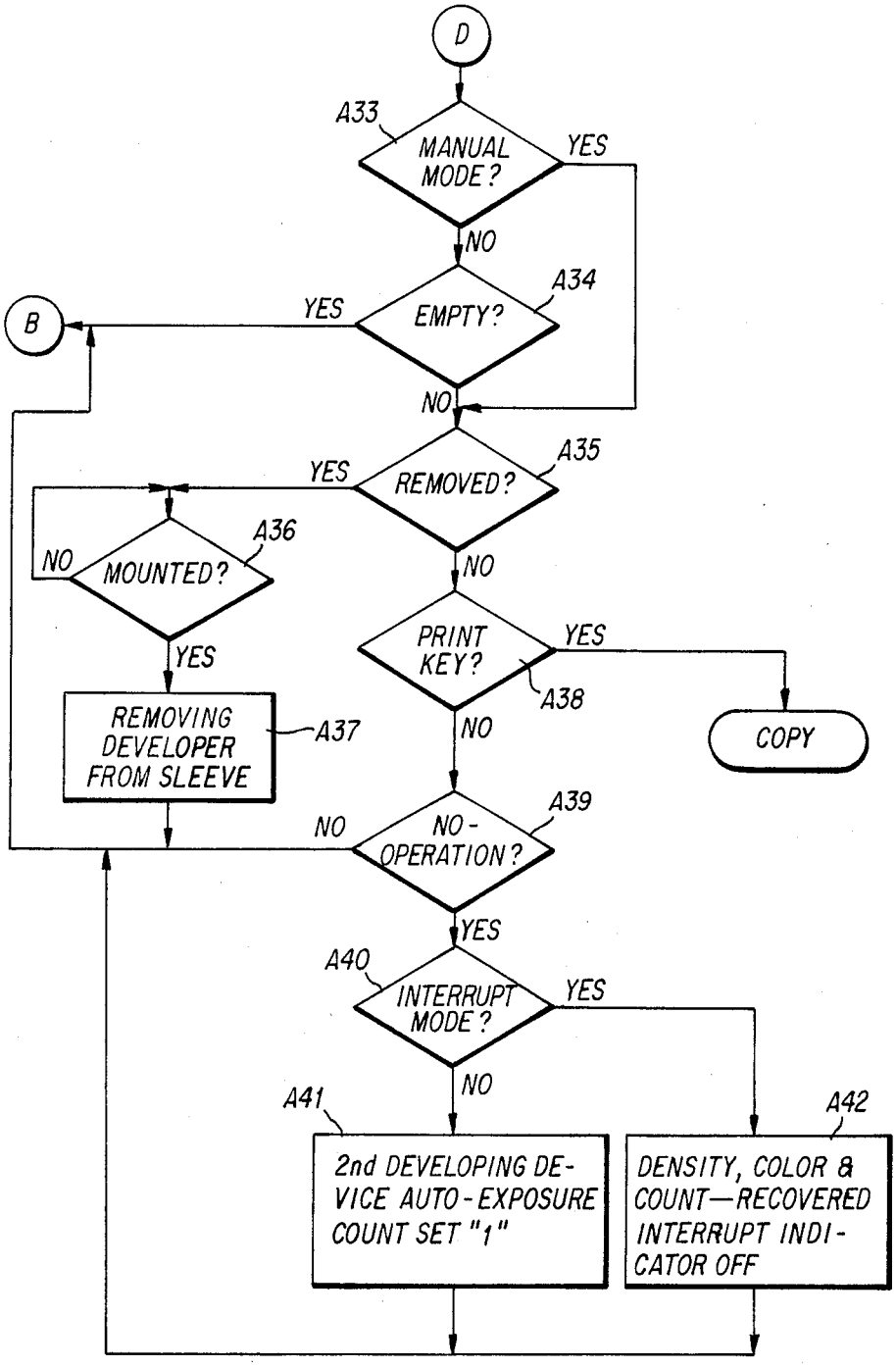
Figure 18A:
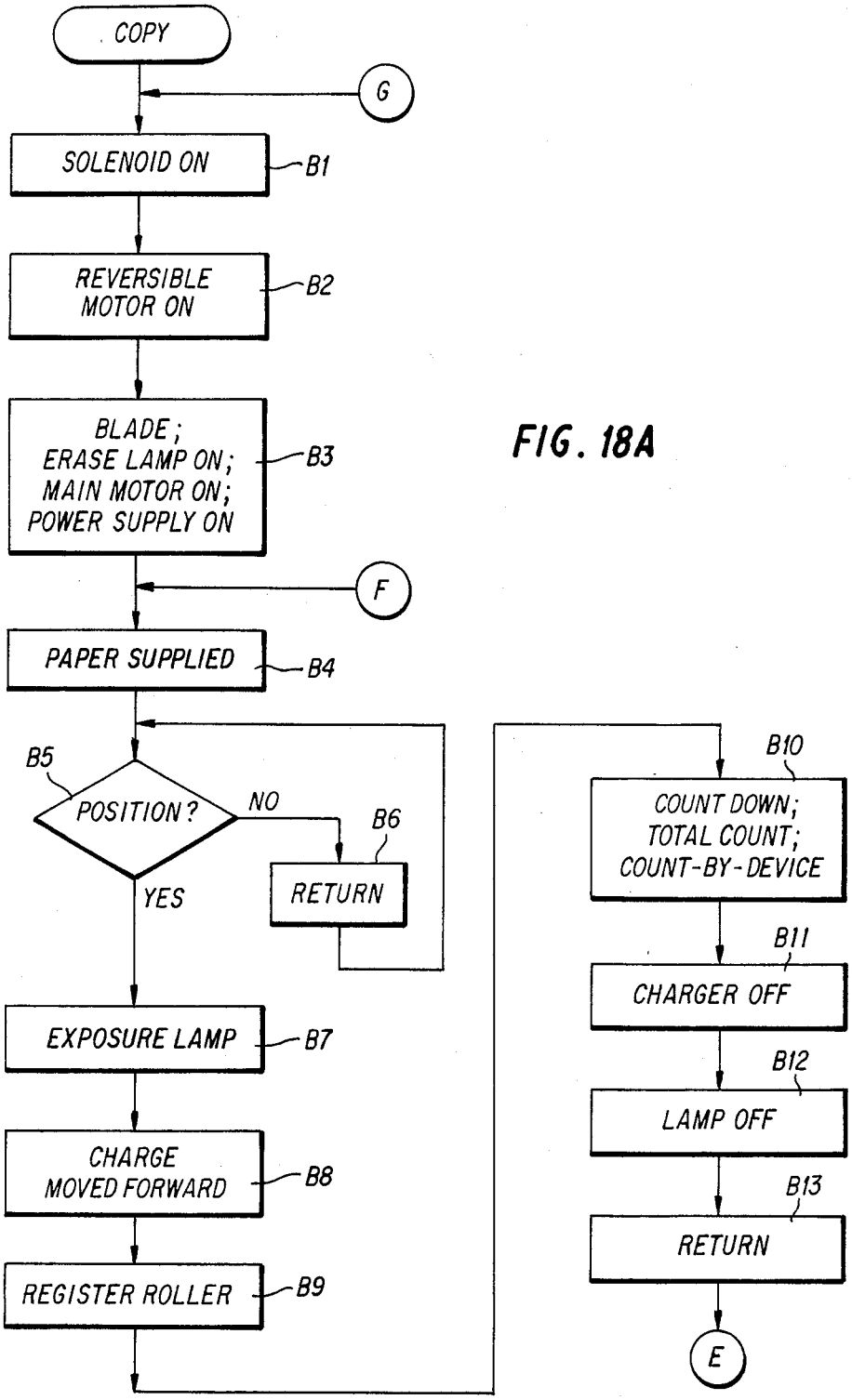
Figure 18B:
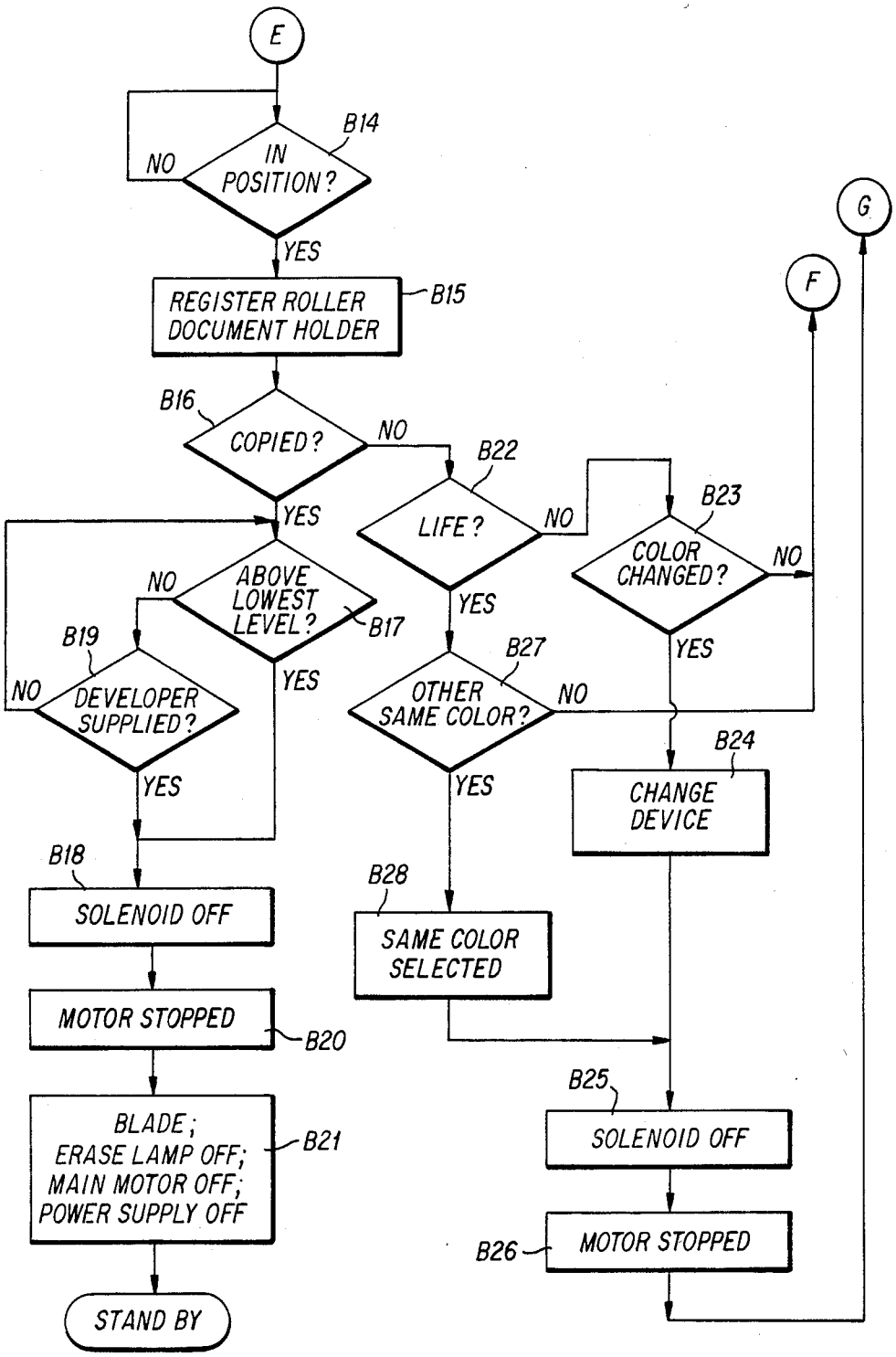

The developing device presence/absence signal generating means 187A and 187B and the identification generating means 188A and 188B, as shown in FIG. 16, output their respective signals and identification codes via a developing device connector used to connect the developing device to the control circuit. A connector 191 is composed of a jack 192 and a plug 193. The jack 192 is installed in the developing device, and the plug 193 is connected via the cable to the control circuit shown in FIG. 15.

The design of the jack 92 is such that the connection of a terminal 194E to a common terminal 194A permits a developing device presence/absence signal to be generated, and the connection of a terminal 194A to one of the terminals 194B thru 194D in accordance with the developing device permits a 3-bit identification code to be generated.

The terminal 195A is grounded at the plug 193 in the control circuit side, and the terminals 195B thru 195E are connected to the input interface circuit 172. With the jack 192 connected with the plug 193, the terminals are connected correspondingly, permitting the appropriate 3-bit identification code to be obtained from terminals 195B thru 195D for the plug 193 and a developing device presence signal to be obtained from the terminal 195E. When the jack 192 is not connected with the plug 193, no developing device presence signal is obtained from the terminal 195E of the plug 193 indicating that there is no developing device.

The memory 175, which is constructed, for example, of CMOS RAMSs, is used as a counter which counts the number of copies. In this embodiment, counters which count the number of copies by the developing device and a counter which counts the total number of copies are provided. The appropriate counter is selected by address specification in accordance with the identification code for the developing device storing counting data. The counting data of the above counters is composed, for example, of 4 bits×5 and is represented in BCD code. The counting data of the counter which counts the total number of copies is composed, for example, of 4 bits×6 and is also represented in BCD code.

Operation during power on is explained using the flowchart shown in FIG. 17. When the apparatus is energized, operation proceeds to the step A1. In the step A1, the second developing device 32B storing the reference black developer and the automatic exposure mode are selected. In step A2, the heater lamp for the fuser roll 19 is turned on, and, in step A3, the pole position selecting solenoid 109 of the second developing device 32B is turned off and the reversible motor is revolved reversely.

In step A4, the reverisble motor 63 is stopped, and operation proceeds to step A5 whereby the pole position selecting solenoid 109 of the first developing device 32A is turned off and the reversible motor is forwardly revolved. In step A6, the reversible motor 63 is stopped, and, in step A7, the main motor 28 is turned on for a certain time period.

In step A8, the heat roller is checked to determine if it is fully warmed. If it is, the symbol 163 on the operation panel which indicates that copying can be done is turned on, leading to a standby status. In step A9, key operations on the operation panel are accepted. During step A10, a check is made to see if the interrupt key 152 has been turned on. If not, operation proceeds to step A11, and if so, operation proceeds to step A12.

Step A12 checks to see if the interrupt mode is established; if not, operation proceeds to the step A13. In step A13, the copying conditions right before the interrupt key 152 was turned on are saved in a RAM **171*b* in the microcomputer 171. The second developing device 32B** storing the black developer and the automatic exposure mode are selected, and the number of copies is set to "1" to set up the interrupt mode. Thus, when the interrupt mode is established, the previous copying conditions are saved in a RAM, and the reference black copying mode is selected.

In step A14 the interrupt indicator 153 on the operation panel is turned on and operation proceeds to step A11.

If in step A12 it is determined that the interrupt mode is established, operation proceeds to step A15. In step A15 the copying conditions saved in step A13 are recovered, developing device and exposure mode selection are reset, the interrupt mode is releases, and operation proceeds with step A16. In step A16 the interrupt indicator 153 on the operation panel is extinguished, and operation proceeds to step A11.

In step A11, it is determined whether the developing device presence/absence signal from the second developing device 32B indicates that second developing device 32B has been mounted. If not, operation proceeds to step A17, wherein a developing device presence/absence signal from the first developing device 32A first developing device 32A has been mounted. If not, operation proceeds to step A18 whereby the color indicators 157 thru 160 on the operation panel and the symbol 163 which indicates that copying can be done are extinguished. Operation returns to the standby state. In such a manner, the color indicators 157 thru 160 are prohibited from indicating colors, unless both of the first and second developing device 32A and 32B are mounted.

If the second developing device 32B is mounted, operation proceeds to step A19 wherein it is determined if the first developing device 32A has been mounted. If so, operation proceeds to step A20, in which it is determined if the color selection key has been turned on. If so, operation proceeds to step A21 to check to see if the second developing device 32B is currently selected. If not, operation proceeds to step A22 which selects the second developing device 32B, and causes operation to proceed to step A23.

In step A19, if it is determined that the first developing device 32A is not mounted, step A20 and A21 are not performed and operation proceeds to step A22. In step A20, if the color selection key 156 is not turned on, steps A21 and A22 are also not performed and operation proceeds to step A23.

In step A17, if the first developing device 32A has been mounted, or in step A21 if the second developing device 32B has been selected, operation proceeds to step A24 to select the first developing device 32A, and to cause operation to proceed to step A23. In such a manner, the developing device is prohibited from being selected if one or both of the first and second developing devices 32A and 32B is not mounted.

Operating according to step A23, the copier displays the color for a selected developing device, identifies the color of a stored developer by the identification code output fed from the selecting developing device, and turns on the appropriate color indicator on the operation panel. For black, the color indicator 157 is turned on, and for red, the color indicator 158 is turned on.

Color indication is followed by step A25 which signals from the developer level detectors 117A and 117B are checked to determine whether either of the first and second developing devices 32A and 43B has been exhausted. If neither of the developing devices is exhausted, operation proceeds to step A26. Step A26 turns off the developer absence indicators 140A and 140B for the first and second developing devices 32A and 32B, and causes operation to proceed to step A27. In step A25, if either of the developing devices has been exhausted, operation proceeds to step A28 to check to see if the hopper cover 131 of the developing device 10 is closed as indicated by the signal from the cover open/-close detector 135. If so, operation proceeds to step A26, and if not, operation proceeds to step A29. Step A29 turns on the developer absence indicator 140A or 140B for an exhausted developing device, and causes operation to proceed to step A27. Thus, if the hopper 51A or 51B for the first or second developing device 32A or 32B has been exhausted, the developer absence indicator 140A or 140B mounted in the vicinity of the opening 140A or 140B is turned on. Only when the hopper cover is opened is the developer absence indicator 140A or 140B turned on. Step A27 checks to see if the selected developing device is exhausted; if not, operation proceeds to step A30.

Step A30 extinguishes the developer absence indicator symbol 165 on the operation panel, and causes operation to proceed to step A31. In step A27, if the selected developing device is exhausted, operation proceeds to step A32. In step A32, the developer absence indicator symbol 165 on the operation panel is turned on and operation proceeds to step A31. Only when the selected developing device has been exhausted is that condition indicated by a display on the operation panel.

Step A31 checks to see if there is trouble, e.g., a malfunction, in the copying machine. If there is trouble, malfunction processing is carried out, and if there is no trouble, operation proceeds to step A33.

In step A33 a check is made to see if the manual paper supply mode, i.e., the mode in which the manual paper supply 6 is used, has been established. If the manual paper supply mode has not been established, operation proceeds to the step A34 to see if the paper supply cassette contains paper P1. If not, the standby state is established. If the cassette contains paper, operation proceeds to step A35.

In step A33, if the manual paper supply mode is established, operation proceeds to step A35 to check to see if the developing device has been removed. This is accomplished by examining the developing device presence/absence signals from the first and second developing devices 32A and 32B. If the developing device has been removed, operation proceed to step A36 to check by signals from the cover open/close detector 135 to see if the developing device has been mounted securely.

If the cover open/close detector 135 detects that hopper cover 131 is closed, the developing device is considered to be mounted and operation proceeds to step A37. In step A37, by the above-mentioned operation, the developer on the sleeve of the removed developing device is eliminated to set up the standby state. If the developing device has been removed with power on, after the developing device is mounted securedly, the developer on the sleeve for the removed developing device will be eliminated.

If the developing device has not been removed, operation proceeds to step A38 to check to see if the copying key 151 on the operation panel has been turned on. If it has been turned on, copying proceeds, and if not, operation proceeds to step A39. Step A39 checks to see if key operations have been performed on the operation panel within a certain time period. If operations have been performed, the standby state is established, and if not, operation proceeds to step A40.

Step A40 checks to see if the interrupt mode is currently established. If not, operation proceeds to step A41 to select the second developing device 32B storing the black developer and the automatic exposure mode, and to set the number of copies at "1" to set up the standby state. If no operations are carried out for a certain time period after the termination of general copying operations, the reference black copying mode and the automatic exposure mode are selected.

If step A40 detects that the interrupt mode is set up, operation proceeds to step A42 to restore the copying conditions saved during interrupt mode setting and to extinguish the interrupt indicator 153 on the operation panel. This again sets up the standby state. If no operations are carried out for a certain time period after the termination of interrupt copying in the interrupt mode, the state in wich the copier operated immediately prior to the start of the interrupt mode is established.

If the copying key 151 on the operation panel is turned on, operation proceeds to step B1 to turn on the pole position selecting solenoid for a selected developing device. Step B2 causes the reversible motor 63 to revolve to the direction of the selected developing device. Step B3 turns on the blade solenoid 29 of the cleaning device 13, the erase lamp 14, the main motor 28, the transferring power supply 181, the transfer charger 11, the separating power supply 182, the separation charger 12, and the developing bias power supply 179.

Step B4 starts up the paper supply operation from the paper supply cassette, and causes operation to proceed to step B5 to check to see if the document stage 2 is in a predetermined position. If not, operation proceeds to step B6 to put the document stage in the predetermined position. If the document stage 2 is returned in the predetermined position, operation proceeds to the step B7 to turn on the exposure lamp. Step B8 turns on the charging power supply 180 for the charger 8 to cause the drum 7 to begin to be charged, and starts document scanning by moving the document stage forward.

In step B9, the register roller 18 revolves to feed paper P1 to the image duplicating section 16.

Step B10 subtracts "1" from the displayed contents of the copy count display 155 on the operation panel, and adds "1" to the counter for the total number of copies and to the counter for a selected developing device in the memory 175. Step B11 turns off the charging power supply 180 to stop the charging of the drum 7.

During step B12, the exposure lamp is turned off and, in step B13, the document stage is moved backward. Step B14 checks to see if the document stage has been returned to its starting position. If it has been returned, step B15 stops the register roller from being revolved and the document stage 2 from being moved backward. Step B16 checks to see if a specified number of papers have been copied. If so, step B17 checks to see if the developer concentration of a selected developing device is above the lowest concentration level by signals from the developer concentration detector for the selected developing device. If it is above the lowest concentration level, operation proceeds to step B13, and if not, operation proceeds to step B19.

Step B19 checks to see if the developer has been supplied successively for a certain time period. If not, operation returns to step B17 for repetition of the above operation, and if supplied, operation proceed to step B18. This automatic developer concentration control monitors a proper concentration level, and a lowest concentration level, so as not to vary fluid characteristics of the developer. During termination of the copying operation, the developing device is driven until the developer concentration reaches the minimum concentration level necessary for continued developer supply. Step B18 turns off the pole position selecting solenoid 109, and causes operation to proceed to step B20 to stop the reversible motor 63 and to cause operation to proceed to the step B21. Step B21 turns off the blade solenoid 29, the main motor 28, the erase lamp 14, the transferring power supply 181, the separating power supply 182, and the developing bias supply 179, to set up the standby state.

In step B16, if a set number of copies have not been made, operation proceeds to the step B22 to check to see if the counters for the number of copies in the storage 175 are set at predetermined values, or to check the life of the developer. If the developer is still usable, operation proceeds to the step B23 to check to see if a color change request flag is set at "1", or if a color change request has been issued. If not (flag=0), operation returns to step B4 for repetition of the above operations.

If a color change request (flag=1) has been issued, operation proceeds to the step B24 to change developing device selection. Step B25 turns off the pole position selecting solenoid for the selected developing device, and causes operation to proceed to step B26. Step B26 stops the reversible motor 63, and returns operation to step B1 for repetition of the above operations.

If a developing device selection change request has been issued during copying operations, the appropriate developing device is selected, after the image being copied finishes being developed. In step B22, if the developer life has expired, operation proceeds to step B27 to see if there is another developing device with the same color. If not, operation returns to step B4 for repetition of the above operation.

If there is another developing device with the same color, operation proceeds to step B28 to select the same color developing device and to cause operation to proceed to step B25.

If the useful life of the developer for a developing device being used has expired, priority is given to the other developing device in particular to a developing device containing the same color developer.

Figure 19A:
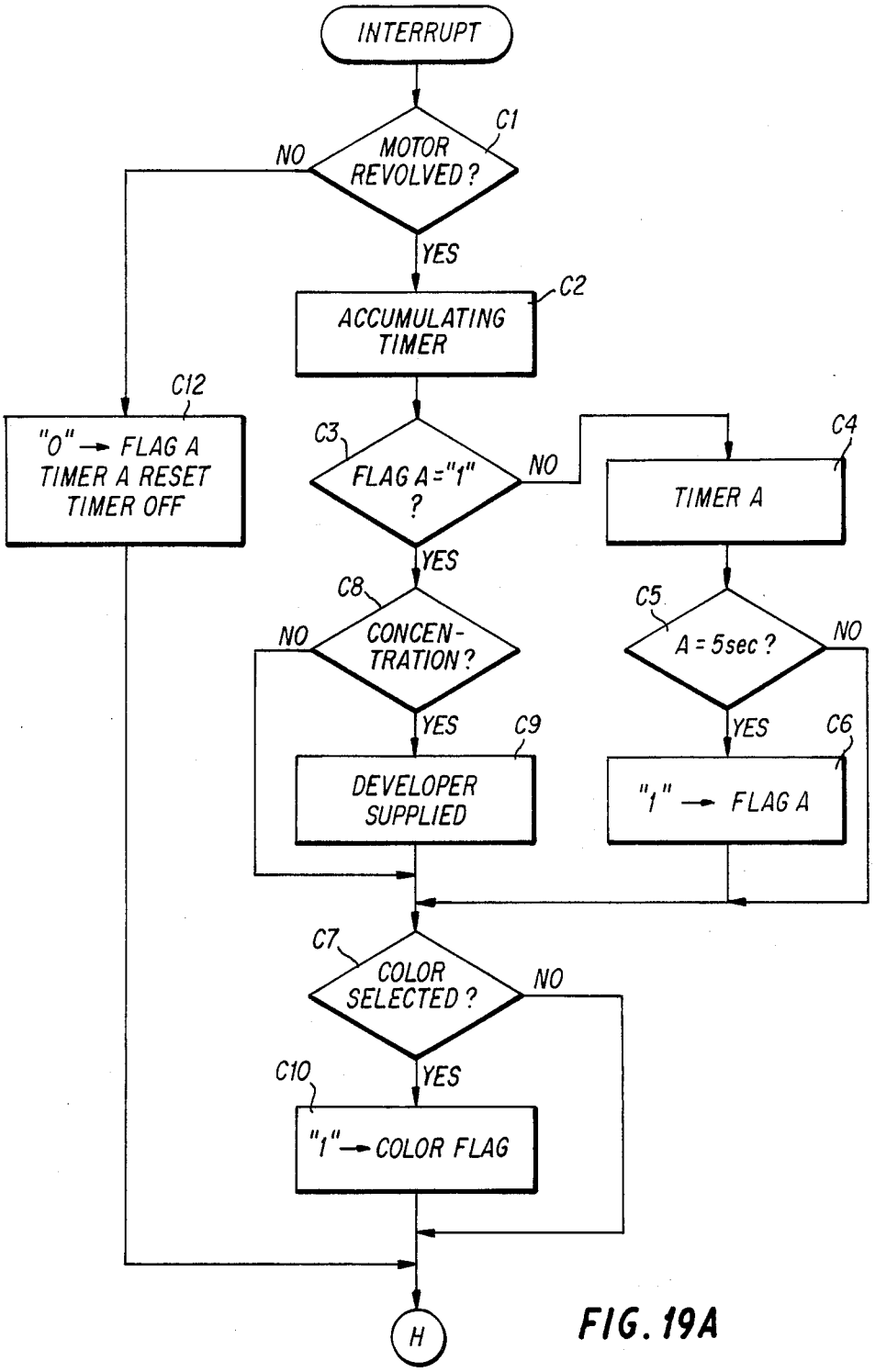
Figure 19B:
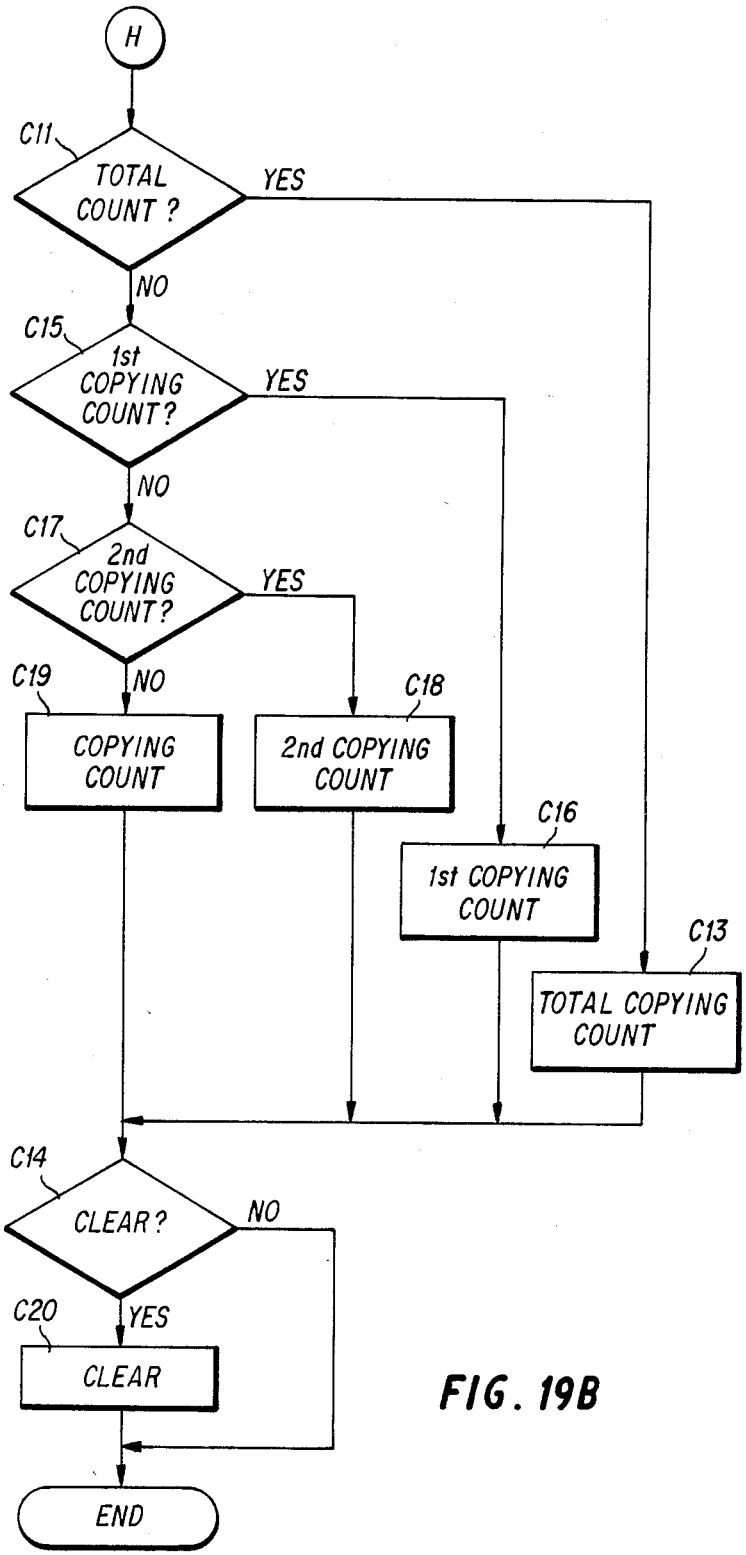

As shown in FIG. 19, interrupt processing is set so that is is repeated after certain time periods. At the beginning of interrupt processing, operation proceeds to step C1 to check to see if the reversible motor 63 is being revolved (the developing device is being operated). If it is being revolved, operation proceeds to step C2 to supply the accumulating timer 139A or 139B for a selected developing device and to cause operation to proceed to step C3.

Step C3 checks to see if the flag A is set to "1". If not, operation proceeds to step C4 to start the timer A and, in step C5, the timer A is checked to determine if 5 seconds have elapsed. If 5 seconds have passed, operation proceeds to step C6 to set flag A to "1" and to cause operation to proceed to step C7. If 5 seconds have not yet elapsed, operation proceeds to step C7.

In step C3, if the flag A is set to "1", operation proceeds to step C8 to check to see if the developer concentration of a selected developing device is below a certain preset value. This is accomplished by processing the signals from the developer concentration detector for the selected developing device. If it is below the preset value, operation proceeds to the step C9 wherein the developer supply roller for the selected developing device is driven to supply developer. In step C8, if the developer concentration is determined to be higher than a preset value, operation proceeds to step C7. In such a manner, the developer begins to be supplied to the magnetic roll after the start of copying operation, and after the developer supplied to the developer concentration detector becomes stable (which typically takes about 5 seconds). Concentration checking is done with the outputs from the developer concentration detector.

If a developing device selection change request has been issued during copying operations, the appropriate developing device is selected, after the image being copied finishes being developed. In step B22, if the developer life has expired, operation proceeds to step B27 to see if there is another developing device with the same color. If not, operation returns to step B4 for repetition of the above operation.

If there is another developing device with the same color, operation proceeds to step B28 to select the same color developing device and to cause operation to proceed to step B25.

If the useful life to the developer for a developing device being used has expired, priority is given to the other developing device in particular to a developing device containing the same color developer.

As shown in FIG. 19, interrupt processing is set so that is is repeated after certain time periods. At the beginning of interrupt processing, operation proceeds to step C1 to check to see if the reversible motor 63 is being revolved (the developing device is being operated). If it is being revolved, operation proceeds to step C2 to supply the accumulating timer 139A or 139B for a selected developing device and to cause operation to proceed to step C3.

Step C3 checks to see if the flag A is set to "1". If not, operation proceeds to step C4 to start the timer A and, in step C5, the timer A is checked to see if 5 seconds have elapsed. If 5 seconds have passed, operation proceeds to step C6 to set flag A to "1" and to cause operation to proceed to step C7. If 5 seconds have not yet elapsed, operation proceed to step C7.

In step C3, if the flag A is set to "1", operation proceeds to step C8 to check to see if the developer concentration of a selected developing device is below a certain preset value. This is accomplished by processing the signals the developer concentration detector for the selected developing device. If it is below the preset value, operation proceeds to the step C9 wherein the developer supply roller for the selected developing device is driven to supply developer. In step C8, if the developer concentration is determined to be higher than a preset value, operation proceeds to step C7. In such a manner, the developer begins to be supplied to the magnetic roll after the start of copying operation, and after the developer supplied to the developer concentration detector becomes stable (which, as mentioned above, typically takes about 5 seconds). Concentration checking is done with the outputs from the developer concentration detector.

Step C7 checks to see if the color selection key 156 on the operation panel has been turned on; if it has been turned on, operation proceeds to step C10. In step C10, the color change request flag is set to "1". Unless the color selection key 156 has been turned on in the step C7, operation skips step C10, and proceeds to step C11.

In step C1, if the reversible motor is not being revolved, operation proceeds to the step C12. In step C12 the flag A is set to "0", the timer A is reset, the accumulating timer is stopped, and operation proceeds to step C11.

Step C11 checks to see if a total copy count display request (entered in a secret code from numeric keys 154 on the operation panel) has been issued; if it has been issued, operation proceeds to step C13. Step C13 transfers the contents of the counter for the total number of copies in the storage 175 to the copy count display on the operation panel.

In the step C11, if the total copy count display request has not been issued, operation proceeds to step C15 to check to see if a request for displaying the copy count for the first developing device 32A (entered in a secret code by numeric keys) has been issued. If the request has been issued, step C16 transfers the contents of the counter in the storage 175 for the first developing device 32A to the copying count display 155, and causes operation to proceed to the step C14.

If, in step C15, a display request has not been issued, operation proceeds to step C17 to check to see if a request for displaying the copy count for the second developing device 32B (entered in a secret code by numeric keys 254) has been issued. If a request has been issued, step C18 transfers the contents of the counter in the storage 175 for the second developing device 32B to the copy counter display 155, and causes operation to proceed to step C14. If no display request has been issued, operation proceeds to step C19 to transfer the copy count on the copy count display 155. Step C14 checks to see if a request to clear the copy count by developing device (entered by numeric keys 154 in a secret code) has been issued; if no clear request has been issued, interrupt processing is terminated.

If a clear request has been issued, step C20 clears the contents of the copy counter for a specified developing device in the storage 175, and terminates interrupt processing. In the above explanation, the flag refers to a particular bit position in the RAM of the microcomputer that has been assigned to store the flag value.

The above construction is such that, when the interrupt mode is set up during any color copying mode, the reference black copying mode is established. This permits the reference black copying mode to be set up automatically when the interrupt mode is established and makes it unnecessary for the operator to operate keys for setting up the reference black copying mode. Copying operations are thus more convenient and easier to perform. Moreover, any color developing device may be selected even during the interrupt mode, and when the interrupt mode is released, the prior existing state is reestablished.

In the above exemplary embodiment, the reference color is assumed to be black, but any other color may be introduced as the reference color.

The above exemplary embodiment is applied to a monochrome color copying machine; but this invention is not limited to this application, and can be applied to image-forming apparatus which forms images using a developing device such as so-called multiple color copying machines, which superpose and copy several colors, and facsimiles.

While the invention has been particularly shown and described with reference to preferred embodiments thereof, it will be understood by those skilled in the art that many changes can be made in form and details therein without departing from the spirit and scope of the invention.

What is claimed is:

1. An image-forming apparatus comprising:

selection means for selecting one of a first color and a preset reference color as a selected color;

interrupt means for selectively causing said image-forming apparatus to operate in an interrupt mode;

image-forming means responsive to said selection means for forming said image on a recording medium in said selected color when said image-forming apparatus operates in a mode other than said interrupt mode; and control means, responsive to said interrupt means and controllingly connected to said image-forming means, for causing said image-forming means to be unresponsive to said selection means and to form said image on said recording medium in said preset reference color regardless of whether said preselected reference color has been selected or said selected color when said image-forming apparatus operates in said interrupt mode.

2. An apparatus according to claim 1 wherein said control means is further responsive to said interrupt means, for causing said image-forming means to be responsive to said selection means when said image-forming means operates in said other mode after the end of operation in said interrupt mode.

3. An image-forming apparatus according to claim 1 wherein said control means includes scheduling means for controlling said selecting means to select one of said first color and said preset reference color responsive to the end of said interrupt mode.

4. An image-forming apparatus according to claim 1 wherein said image-forming means comprises:

a first printing station;

a second printing station; and a toner supply device for supplying a toner of said first color and a toner of said preset reference color to said first and second printing stations, respectively.

5. An image-forming apparatus according to claim 4 further including a toner level measuring device for indicating the level of one of said first color toner and said preset reference color toner in said toner supply device.

6. An image-forming apparatus according to claim 5 further including a toner concentration device for indicating the concentration of one of said first color toner and said preset reference color toner in said toner supply device.

7. An image-forming apparatus comprising:

means for forming latent images on a recording medium;

a first developing device for applying colored developer to said latent images;

a second developing device for applying black developer to said latent images;

first data entry means for entering first control signals for selecting operation of one of said first developing device and said second developing device;

means for activating said one of said first developing device and said second developing device selected by said first control signals and for disabling the operation of the other of said first developing device and said second developing device;

memory means for storing data, including a first storage area and a second storage area;

means for storing in said first storage area first image-forming control information including said first control signals entered by said first data entry means;

first control means for controlling said first developing device, said second developing device, and said activating and disabling means in accordance with said control information stored in said first storage area to perform image-forming operations;

second data entry means for entering an interrupt control signal; and second control means responsive to said interrupt control signal for transferring said first image-forming control information from said first storage area to said second storage area and for storing in said first storage area second image-forming control information, including second control signals, for controlling said first control means to cause said activating and disabling means to select said second developing device for developing said latent images.

8. An image-forming apparatus according to claim 7 further including means for removing said first developing device from the apparatus.

9. An image-forming apparatus according to claim 8 wherein said first control means includes means for preventing said first developing device from being selected for developing said latent images when said first developing device has been removed from the apparatus.

10. An image-forming apparatus comprising:

means for forming latent images on a recording medium;

a first developing means for developing said latent images formed by said forming means;

a second developing means for developing said latent images formed by said forming means;

means for entering control signals to select for operation one of said first and second developing means;

means for controlling said first and second developing means to develop said latent images in accordance with said control signals;

means for establishing and terminating an interrupt mode;

means for storing said control signals responsive to the establishing of said interrupt mode; and means responsive to the establishing of said interrupt mode for selecting a predetermined one of said first and second developing means for developing said latent images.

11. An image-forming apparatus according to claim 10 further including:

means for determining a first time period corresponding to the cumulative time said first developing means is operated to develop said latent images and a second time period corresponding to the cumulative time said second developing means is operated to develop said latent images; and memory means for storing said first time period and said second time period.

12. An image-forming apparatus according to claim 11 wherein said first developing means includes a first rotatable developer supply drum, and wherein said second developing means includes a second rotatable developer supply drum, said first and second drums being adapted to supply a first developer and a second developer to said forming means responsive to the selection of said first developing means and said second developing means, respectively.

13. An image-forming apparatus according to claim 12 further including a reversible motor for rotating said first rotatable drum in a first direction in response to the selection of said first developing means and for rotating said second rotatable drum in a second direction opposite to said first direction in response to the selection of said second developing means.

14. An image-forming apparatus according to claim 13 wherein said determining means includes an accumulating timer for setting said first time period to a value corresponding to the cumulative time said first drum is rotated in said first direction and said second time period to a value corresponding to the cumulative time said second drum is rotated in said second direction.

15. An image-forming apparatus according to claim 10 wherein said storing means comprises a non-volatile memory.

* * * * *